US011060720B2

(12) United States Patent
Karnani et al.

(10) Patent No.: US 11,060,720 B2
(45) Date of Patent: Jul. 13, 2021

(54) PLASMA PILOT

(71) Applicant: ClearSign Combustion Corporation, Seattle, WA (US)

(72) Inventors: Sunny Karnani, Silver Spring, MD (US); James K. Dansie, Renton, WA (US); Jackson M. Pleis, Carnation, WA (US)

(73) Assignee: CLEARSIGN TECHNOLOGIES CORPORATION, Seattle, WA (US)

( * ) Notice: Subject to any disclaimer, the term of this patent is extended or adjusted under 35 U.S.C. 154(b) by 168 days.

(21) Appl. No.: 16/404,480

(22) Filed: May 6, 2019

(65) Prior Publication Data

US 2019/0323707 A1 Oct. 24, 2019

Related U.S. Application Data

(63) Continuation of application No. PCT/US2017/058848, filed on Oct. 27, 2017.
(Continued)

(51) Int. Cl.
*F23D 14/14* (2006.01)
*F23D 14/22* (2006.01)
(Continued)

(52) U.S. Cl.
CPC ..... *F23D 14/145* (2013.01); *F23D 14/22* (2013.01); *F23D 14/32* (2013.01); *F23D 14/56* (2013.01);
(Continued)

(58) Field of Classification Search
CPC ..... F23C 99/001; F23D 14/14; F23D 14/145; F23D 2203/102–104; F23N 5/265
(Continued)

(56) References Cited

U.S. PATENT DOCUMENTS 1,983,430 A 12/1934 Ashcraft
2,095,065 A 10/1937 Plays
(Continued)

FOREIGN PATENT DOCUMENTS

GB 1042014 9/1966
WO WO 93/18342 9/1993
(Continued)

OTHER PUBLICATIONS

PCT International Search Report and Written Opinion dated Jan. 31, 2018, for International Patent Application No. PCT/US2017/058848 filed Oct. 27, 2017.
(Continued)

*Primary Examiner* — Vivek K Shirsat
(74) *Attorney, Agent, or Firm* — Christopher A. Wiklof; Launchpad IP, Inc.

(57) ABSTRACT

A combustion system includes a perforated flame holder, a fuel nozzle configured to output fuel toward the perforated flame holder, and a plasma ignition device configured to output a plasma during a preheating state of the combustion system and to cease outputting the plasma to transition from the preheating state to the standard operating state. In the preheating state the plasma ignition device causes a preheating flame of the fuel stream at a position between the fuel nozzle and the perforated flame holder. In the standard operating condition, the plasma is not present and the fuel stream impinges on the perforated flame holder. The perforated flame holder supports a combustion reaction of the fuel stream within the perforated flame holder when in the standard operating state.

50 Claims, 18 Drawing Sheets

Related U.S. Application Data

(60) Provisional application No. 62/417,916, filed on Nov. 4, 2016.

(51) Int. Cl.

| | |
|---|---|
| ***F23D 14/32*** | (2006.01) |
| ***F23D 14/56*** | (2006.01) |
| ***F23D 14/58*** | (2006.01) |
| ***F23Q 13/00*** | (2006.01) |
| ***H05H 1/48*** | (2006.01) |

(52) U.S. Cl.
CPC ..... *F23D 14/58* (2013.01); *F23Q 13/00* (2013.01); *H05H 1/48* (2013.01)

(58) Field of Classification Search
USPC ..... 431/8, 354, 7, 326–329, 18, 356, 258; 422/186.26
See application file for complete search history.

(56) References Cited

U.S. PATENT DOCUMENTS

| | | | | |
|---|---|---|---|---|
| 2,604,936 | A | | 7/1952 | Kaehni et al. |
| 2,828,813 | A | | 4/1958 | Holden |
| 2,942,420 | A | | 6/1960 | Clark |
| 3,008,513 | A | | 11/1961 | Holden |
| 3,358,731 | A | | 12/1967 | Donnelly |
| 4,081,958 | A | | 4/1978 | Schelp |
| 4,332,223 | A | * | 6/1982 | Dalton ..... F02B 19/108 123/253 |
| 4,362,016 | A | | 12/1982 | Papadopulos |
| 4,473,349 | A | * | 9/1984 | Kumatsu ..... F23C 5/00 431/116 |
| 4,483,673 | A | | 11/1984 | Murai et al. |
| 4,588,373 | A | | 5/1986 | Tonon et al. |
| 4,643,667 | A | | 2/1987 | Fleming |
| 4,644,783 | A | | 2/1987 | Roberts et al. |
| 4,673,349 | A | | 6/1987 | Abe et al. |
| 4,726,767 | A | | 2/1988 | Nakajima |
| 4,752,213 | A | | 6/1988 | Grochowski et al. |
| 4,773,847 | A | | 9/1988 | Shukla et al. |
| 4,850,862 | A | | 7/1989 | Bjerklie |
| 4,995,805 | A | | 2/1991 | Hilliard |
| 5,375,999 | A | | 12/1994 | Aizawa et al. |
| 5,409,375 | A | | 4/1995 | Butcher |
| 5,439,372 | A | | 8/1995 | Duret et al. |
| 5,511,974 | A | | 4/1996 | Gordon et al. |
| 5,620,616 | A | | 4/1997 | Anderson et al. |
| 5,641,282 | A | | 6/1997 | Lee et al. |
| 5,813,835 | A | | 9/1998 | Corsmeier et al. |
| 5,993,192 | A | | 11/1999 | Schmidt et al. |
| 6,129,545 | A | | 10/2000 | Kahlke et al. |
| 6,140,658 | A | | 10/2000 | Jarvinen |
| 6,159,001 | A | | 12/2000 | Kushch et al. |
| 6,270,336 | B1 | | 8/2001 | Terashima et al. |
| 6,561,793 | B1 | | 5/2003 | Narasimhan |
| 6,997,701 | B2 | | 2/2006 | Volkert et al. |
| 7,481,043 | B2 | | 1/2009 | Hirata et al. |
| 7,819,626 | B2 | | 10/2010 | Lee et al. |
| 2002/0092302 | A1 | | 7/2002 | Johnson et al. |
| 2004/0058290 | A1 | | 3/2004 | Mauzey et al. |
| 2005/0208446 | A1 | | 9/2005 | Jayne |
| 2006/0084017 | A1 | | 4/2006 | Huebner et al. |
| 2006/0141413 | A1 | | 6/2006 | Masten et al. |
| 2007/0020567 | A1 | | 1/2007 | Branston et al. |
| 2007/0044449 | A1 | | 3/2007 | O'Brien et al. |
| 2008/0124666 | A1 | | 5/2008 | Stocker et al. |
| 2008/0131265 | A1 | | 6/2008 | Lee et al. |
| 2009/0053664 | A1 | | 2/2009 | Staller |
| 2009/0165436 | A1 | | 7/2009 | Herbon et al. |
| 2010/0178219 | A1 | | 7/2010 | Verykios et al. |
| 2011/0111356 | A1 | | 5/2011 | Claerbout et al. |
| 2011/0126548 | A1 | | 6/2011 | Hammer et al. |
| 2014/0020666 | A1 | | 1/2014 | Plotnikov |
| 2014/0065558 | A1 | | 3/2014 | Colannino et al. |
| 2015/0107260 | A1 | | 4/2015 | Colannino et al. |
| 2015/0121890 | A1 | | 5/2015 | Colannino et al. |
| 2015/0276212 | A1 | | 10/2015 | Karkow et al. |
| 2015/0276213 | A1 | | 10/2015 | Karkow et al. |
| 2015/0276217 | A1 | | 10/2015 | Karkow et al. |
| 2015/0276220 | A1 | | 10/2015 | Karkow et al. |
| 2015/0316261 | A1 | | 11/2015 | Karkow et al. |
| 2015/0330625 | A1 | | 11/2015 | Karkow et al. |
| 2015/0345780 | A1 | | 12/2015 | Krichtafovitch |
| 2015/0369477 | A1 | | 12/2015 | Karkow et al. |
| 2016/0091200 | A1 | | 3/2016 | Colannino et al. |
| 2016/0230984 | A1 | | 8/2016 | Colannino et al. |
| 2016/0238240 | A1 | | 8/2016 | Colannino et al. |
| 2016/0290639 | A1 | | 10/2016 | Karkow et al. |
| 2016/0298840 | A1 | | 10/2016 | Karkow et al. |
| 2016/0348899 | A1 | | 12/2016 | Karkow et al. |
| 2016/0348900 | A1 | | 12/2016 | Colannino et al. |
| 2016/0348901 | A1 | | 12/2016 | Karkow et al. |
| 2017/0010019 | A1 | | 1/2017 | Karkow et al. |
| 2017/0038064 | A1 | | 2/2017 | Colannino et al. |
| 2017/0146232 | A1 | | 5/2017 | Karkow et al. |
| 2017/0191655 | A1 | | 7/2017 | Colannino et al. |
| 2017/0307212 | A1 | | 10/2017 | Kendrick |
| 2017/0350591 | A1 | | 12/2017 | Karkow et al. |
| 2018/0017249 | A1 | | 1/2018 | Colannino et al. |
| 2018/0023807 | A1 | | 1/2018 | Karkow et al. |
| 2018/0023810 | A1 | | 1/2018 | Karkow et al. |
| 2018/0038588 | A1 | | 2/2018 | Karkow et al. |
| 2018/0066846 | A1 | | 3/2018 | Karkow et al. |
| 2018/0087774 | A1 | | 3/2018 | Karkow et al. |
| 2018/0202653 | A1 | | 7/2018 | Karkow |
| 2019/0011123 | A1 | | 1/2019 | Dansie et al. |
| 2019/0107331 | A1 | | 4/2019 | Kendrick et al. |

FOREIGN PATENT DOCUMENTS

| | | |
|---|---|---|
| WO | WO 1995/000803 | 1/1995 |
| WO | WO 1995/034784 | 12/1995 |
| WO | WO 2015/123149 | 8/2015 |
| WO | WO 2016/007564 | 1/2016 |

OTHER PUBLICATIONS

Howell, J.R., et al.; "Combustion of Hydrocarbon Fuels Within Porous Inert Media," Dept. of Mechanical Engineering, The University of Texas at Austin. Prog. Energy Combust. Sci., 1996, vol. 22, p. 121-145.

Arnold Schwarzenegger, "A Low $NO_x$ Porous Ceramics Burner Performance Study," California Energy Commission Public Interest Energy Research Program, Dec. 2007, San Diego State University Foundation.

* cited by examiner

PLASMA PILOT

CROSS REFERENCE TO RELATED APPLICATIONS

The present application is a U.S. Continuation Application which claims priority benefit under 35 U.S.C. § 120 of co-pending International Patent Application No. PCT/US2017/058848, entitled "PLASMA PILOT," filed Oct. 27, 2017. International Patent Application No. PCT/US2017/058848 claims priority benefit from U.S. Provisional Patent Application No. 62/417,916, entitled "PLASMA PILOT," filed Nov. 4, 2016, now expired. Each of the foregoing applications, to the extent not inconsistent with the disclosure herein, is incorporated by reference.

SUMMARY

One embodiment is a combustion system including a perforated flame holder, a fuel nozzle, and a plasma ignition device each positioned in a furnace volume. The fuel nozzle is configured to emit a first fuel stream including a first fuel toward the perforated flame holder. The system also includes an oxidant source configured to output an oxidant into the furnace volume. The combustion system operates in a preheating state and a standard operating state. In the preheating state, the combustion system utilizes the plasma ignition device to preheat the perforated flame holder to a threshold temperature at which the perforated flame holder can support a combustion reaction of the first fuel and oxidant within the perforated flame holder. In the preheating state the plasma ignition device outputs a plasma adjacent to the first fuel stream. The plasma interacts with the first fuel stream and causes the first fuel stream to support a preheating flame at a position between the fuel nozzle and the perforated flame holder. The preheating flame heats the perforated flame holder to the threshold temperature. After the perforated flame holder has been heated to the threshold temperature, the combustion system enters the standard operating state by causing the plasma ignition device to cease outputting plasma. When the plasma ignition device ceases to output plasma, the preheating flame is extinguished, thereby enabling the first fuel stream to continue on its trajectory toward the perforated flame holder and to impinge on the perforated flame holder. Because the perforated flame holder has been heated to the threshold temperature, in the standard operating state the perforated flame holder supports a combustion reaction of the first fuel and oxidant within the perforated flame holder.

According to an embodiment, a method includes outputting, from a fuel nozzle, a first fuel stream including a first fuel toward a perforated flame holder positioned within a furnace volume and introducing a first oxidant into the furnace volume. The method includes preheating the perforated flame holder to a threshold temperature by supporting a preheating flame of the first fuel and the oxidant at a position between the fuel nozzle and the perforated flame holder. The preheating flame is supported by outputting plasma from a plasma ignition device adjacent to the first fuel stream. The method includes removing the preheating flame by ceasing the output of plasma from the plasma ignition device after the perforated flame holder has reached the threshold temperature. The method also includes receiving the first fuel stream and the first oxidant at the perforated flame holder after removing the preheating flame, and sustaining a first combustion reaction of the first fuel and first oxidant within the perforated flame holder.

According to an embodiment, a burner includes a fuel nozzle configured to output a fuel stream including a fuel and a plasma ignition device configured to support a preheating flame with the fuel stream by outputting a plasma adjacent to the fuel stream. The plasma ignition device is configured to enable a combustion reaction of the fuel stream and an oxidant downstream from a location of the preheating flame by ceasing output of the plasma.

According to an embodiment, a burner includes an outer casing, an interior wall within the outer casing, and a fuel channel defined between the outer casing and the interior wall. The burner includes a fluid channel surrounded by the interior wall, an electrode positioned in the fluid channel, and a fluid inlet configured to receive a fluid into the fluid channel. The fluid channel and the electrode are configured to generate a plasma by passing the fluid within the fluid channel adjacent to the electrode. The burner includes a central aperture configured to output the plasma from the fluid channel, an outer casing defining a fuel channel between the interior wall and the outer casing, a fuel inlet configured to receive a first fuel into the fuel channel, an exterior aperture configured to output a fuel stream including the first fuel from the fuel channel.

DETAILED DESCRIPTION

Figure 1:
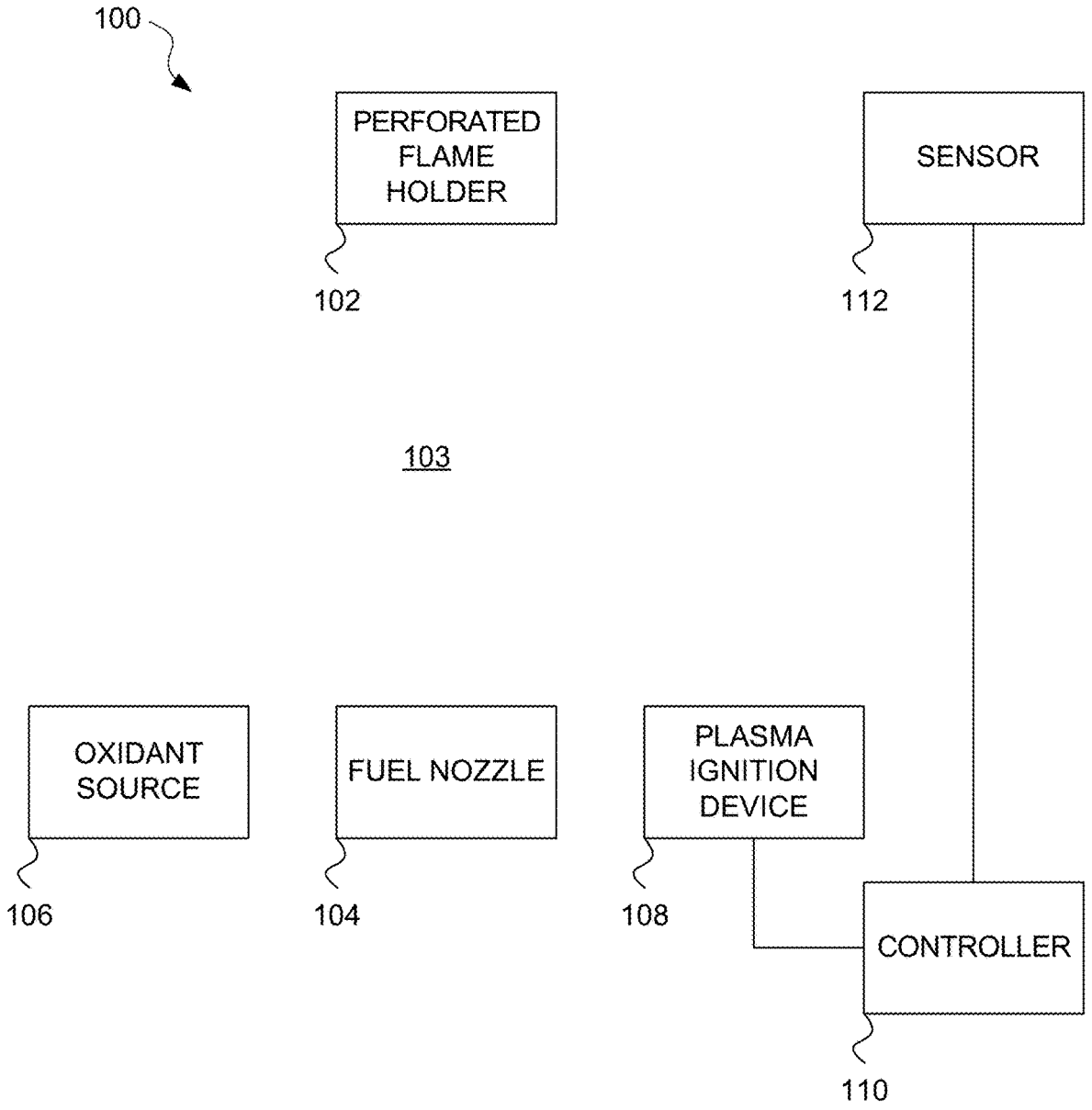
FIG. 1 is block diagram of a combustion system, according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

FIG. 1 is a block diagram of a combustion system 100, according to an embodiment. The combustion system 100 includes a perforated flame holder 102 positioned in a furnace volume 103. The combustion system 100 further includes a fuel nozzle 104, an oxidant source 106, and a plasma ignition device 108.

According to an embodiment, the fuel nozzle 104 is configured to output a first fuel stream including a first fuel toward the perforated flame holder 102. The oxidant source 106 is configured to introduce an oxidant into the furnace volume 103. The first fuel stream entrains the oxidant as it travels toward the perforated flame holder 102.

According to an embodiment, the combustion system 100 can operate in a preheating state and in a standard operating state. In the preheating state, the combustion system 100 supports a preheating flame of the first fuel and oxidant at a position between the perforated flame holder 102 and the fuel nozzle 104. The preheating flame heats the perforated flame holder 102 to a threshold temperature. After the perforated flame holder 102 has been preheated to the threshold temperature, the combustion system 100 enters the standard operating state by removing the preheating flame. In the standard operating state of the combustion system 100, the fuel stream, including the first fuel and the entrained oxidant, enters into the perforated flame holder 102. The perforated flame holder 102 supports a combustion reaction of the fuel and oxidant within the perforated flame holder 102.

According to an embodiment, in the preheating state the combustion system 100 utilizes the plasma ignition device 108 to support the preheating flame at the position between the fuel nozzle 104 and the perforated flame holder 102. In the preheating state, the fuel nozzle 104 outputs the fuel stream toward the perforated flame holder 102 in the same or similar manner as when the combustion system 100 is in the standard operating state. However, during the preheating state the plasma ignition device 108 outputs a plasma adjacent to the fuel stream. The plasma causes the fuel and oxidant to combust at a position between the perforated flame holder 102 and the fuel nozzle 104, thereby sustaining a preheating flame at a position between the perforated flame holder 102 and the fuel nozzle 104. The preheating flame heats the perforated flame holder 102.

According to an embodiment, the combustion system 100 includes a controller 110 and a temperature sensor 112. The controller 110 is coupled to the temperature sensor 112 and the plasma ignition device 108. According to an embodiment, the temperature sensor 112 senses the temperature of the perforated flame holder 102 during the preheating state. The temperature sensor 112 provides to the controller 110 temperature data indicating the temperature of the perforated flame holder 102. When the temperature of the perforated flame holder 102 reaches the threshold temperature at which the perforated flame holder 102 can sustain combustion of the fuel and oxidant, the controller 110 causes the combustion system 100 to exit the preheating state by removing the preheating flame.

According to an embodiment, the controller 110 removes the preheating flame by causing the plasma ignition device 108 to cease outputting plasma. When the plasma ignition device 108 ceases to output plasma, the fuel and oxidant no longer combust at a position between the perforated flame holder 102 and the fuel nozzle 104. More particularly, the characteristics of the fuel stream are such that the fuel and oxidant will not sustain a combustion reaction at a position between the perforated flame holder 102 and the fuel nozzle 104 in the absence of the plasma. Thus, shutting off the plasma ignition device 108 removes the preheating flame.

According to an embodiment, after the preheating flame is removed, the fuel stream impinges on the perforated flame holder 102, entraining the oxidant in route to the perforated flame holder 102. Because the perforated flame holder 102 has been preheated to the threshold temperature, the perforated flame holder 102 sustains a combustion reaction of the fuel and oxidant within the perforated flame holder 102.

According to an embodiment, the controller 110 executes software instructions causing the controller 110 to automatically control the plasma ignition device 108 to output plasma, or to cease outputting plasma, based on the temperature sensor 112. Alternatively, the controller 110 can cause the plasma ignition device 108 to output plasma, or to cease outputting plasma, based on input from a technician. The input can include entering instructions via an input device such as a keyboard, a touchscreen, audio commands, or the like. The temperature sensor 112 can output temperature data to the controller 112 or in a manner that the technician can ascertain the temperature of the perforated flame holder 102. The technician can then cause the controller 110 to adjust the operation of the plasma ignition device 108.

According to one embodiment, the combustion system 100 is functional to allow a technician to directly control the plasma ignition device 108 without the controller 110 by operating switches, buttons, or in another suitable way. Thus, according to an embodiment, the controller 110 may not be present. Additionally, or alternatively, the temperature sensor 112 may not be present. In this case, the technician can view the perforated flame holder 102 to determine, based on the color, or other visual characteristics of the perforated flame holder 102, that the perforated flame holder 102 has reached the threshold temperature. The technician can then cause the plasma ignition device 108 to cease outputting plasma.

According to an embodiment, the fuel nozzle 104 outputs the fuel stream at the same velocity, trajectory, and flow rate in both the preheating state and the normal operating state. The characteristics of the fuel stream are such that absent the energizing effect of the plasma, a stable combustion reaction of the fuel and oxidant cannot be sustained at a position between the fuel nozzle 104 and the perforated flame holder 102.

Figure 2:
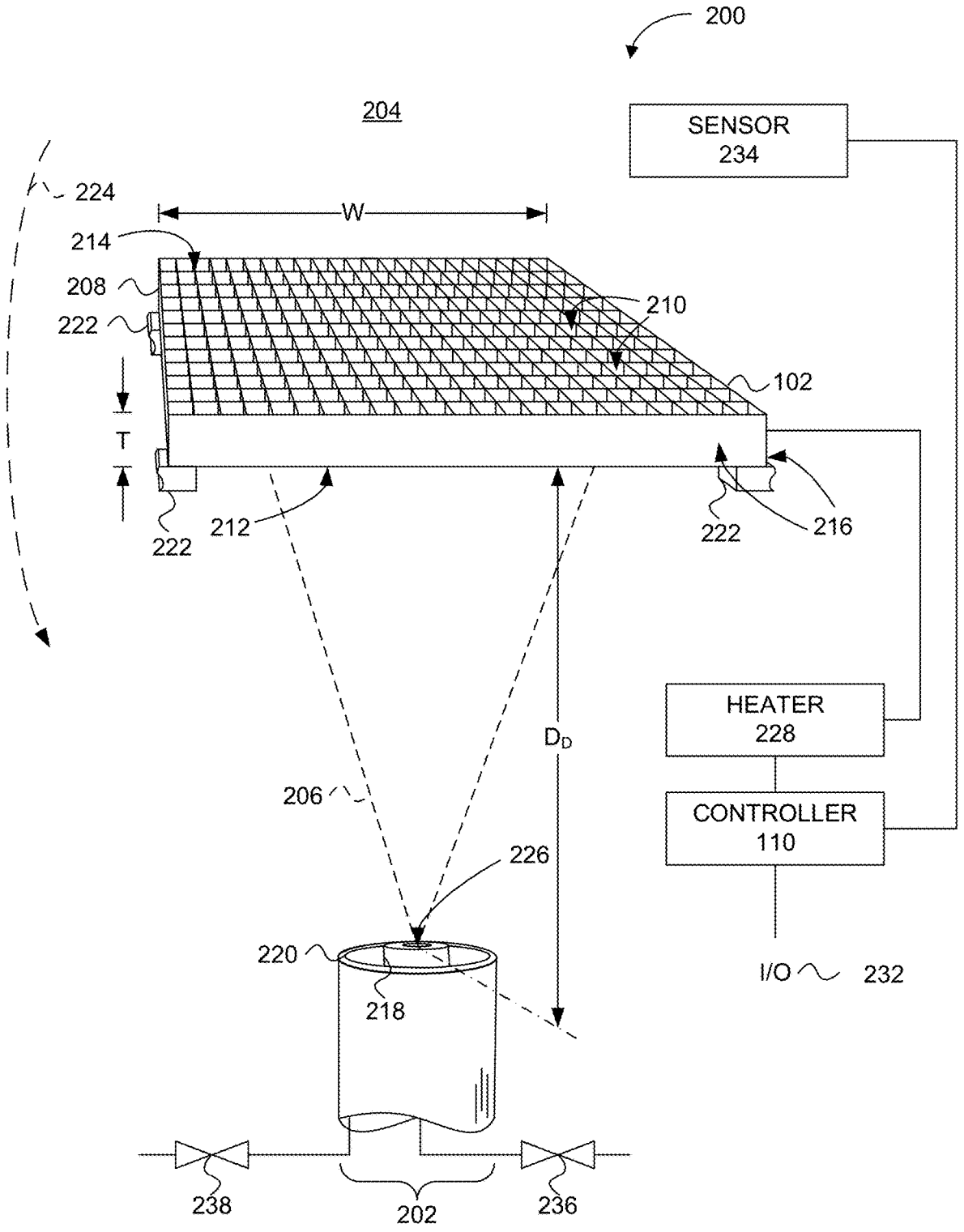
FIG. 2 is a simplified diagram of a burner system including a perforated flame holder configured to hold a combustion reaction, according to an embodiment.

FIG. 2 is a simplified diagram of a burner system 200 including a perforated flame holder 102 configured to hold a combustion reaction, according to an embodiment. As used herein, the terms perforated flame holder, perforated reaction holder, porous flame holder, porous reaction holder, duplex, and duplex tile shall be considered synonymous unless further definition is provided.

Experiments performed by the inventors have shown that perforated flame holders 102 described herein can support very clean combustion. Specifically, in experimental use of systems 200 ranging from pilot scale to full scale, output of oxides of nitrogen (NOx) was measured to range from low single digit parts per million (ppm) down to undetectable (less than 1 ppm) concentration of NOx at the stack. These remarkable results were measured at 3% (dry) oxygen ($O_2$) concentration with undetectable carbon monoxide (CO) at stack temperatures typical of industrial furnace applications (1400-1600° F.). Moreover, these results did not require any extraordinary measures such as selective catalytic reduction (SCR), selective non-catalytic reduction (SNCR), water/steam injection, external flue gas recirculation (FGR), or other heroic extremes that may be required for conventional burners to even approach such clean combustion.

According to embodiments, the burner system 200 includes a fuel and oxidant source 202 disposed to output fuel and oxidant into a combustion volume 204 to form a fuel and oxidant mixture 206. As used herein, the terms fuel and oxidant mixture and fuel stream may be used interchangeably and considered synonymous depending on the context, unless further definition is provided. As used herein, the terms combustion volume, combustion chamber, furnace volume, and the like shall be considered synonymous unless further definition is provided. The perforated flame holder 102 is disposed in the combustion volume 204 and positioned to receive the fuel and oxidant mixture 206.

Figure 3:
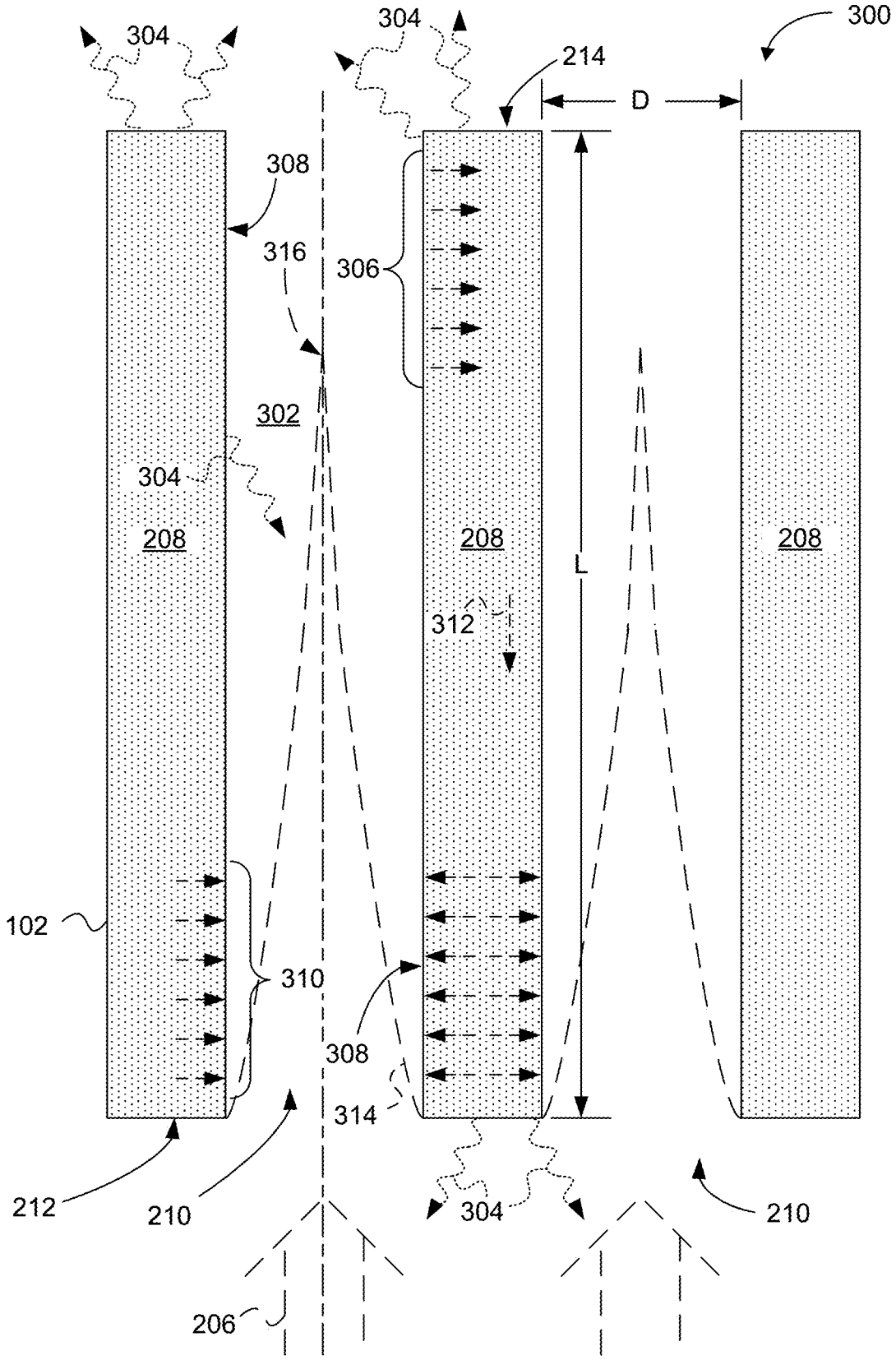
FIG. 3 is a side sectional diagram of a portion of the perforated flame holder of FIGS. 1 and 2, according to an embodiment.

FIG. 3 is a side sectional diagram 300 of a portion of the perforated flame holder 102 of FIGS. 1 and 2, according to an embodiment. Referring to FIGS. 2 and 3, the perforated flame holder 102 includes a perforated flame holder body 208 defining a plurality of perforations 210 aligned to receive the fuel and oxidant mixture 206 from the fuel and oxidant source 202. As used herein, the terms perforation, pore, aperture, elongated aperture, and the like, in the context of the perforated flame holder 102, shall be considered synonymous unless further definition is provided. The perforations 210 are configured to collectively hold a combustion reaction 302 supported by the fuel and oxidant mixture 206.

The fuel can include hydrogen, a hydrocarbon gas, a vaporized hydrocarbon liquid, an atomized hydrocarbon liquid, or a powdered or pulverized solid. The fuel can be a single species or can include a mixture of gas(es), vapor(s), atomized liquid(s), and/or pulverized solid(s). For example, in a process heater application the fuel can include fuel gas or byproducts from the process that include carbon monoxide (CO), hydrogen ($H_2$), and methane ($CH_4$). In another application the fuel can include natural gas (mostly $CH_4$) or propane ($C_3H_8$). In another application, the fuel can include #2 fuel oil or #6 fuel oil. Dual fuel applications and flexible fuel applications are similarly contemplated by the inventors. The oxidant can include oxygen carried by air, flue gas, and/or can include another oxidant, either pure or carried by a carrier gas. The terms oxidant and oxidizer shall be considered synonymous herein.

According to an embodiment, the perforated flame holder body 208 can be bounded by an input face 212 disposed to receive the fuel and oxidant mixture 206, an output face 214 facing away from the fuel and oxidant source 202, and a peripheral surface 216 defining a lateral extent of the perforated flame holder 102. The plurality of perforations 210 which are defined by the perforated flame holder body 208 extend from the input face 212 to the output face 214. The plurality of perforations 210 can receive the fuel and oxidant mixture 206 at the input face 212. The fuel and oxidant mixture 206 can then combust in or near the plurality of perforations 210 and combustion products can exit the plurality of perforations 210 at or near the output face 214.

According to an embodiment, the perforated flame holder 102 is configured to hold a majority of the combustion reaction 302 within the perforations 210. For example, on a steady-state basis, more than half the molecules of fuel output into the combustion volume 204 by the fuel and oxidant source 202 may be converted to combustion products between the input face 212 and the output face 214 of the perforated flame holder 102. According to an alternative interpretation, more than half of the heat or thermal energy output by the combustion reaction 302 may be output between the input face 212 and the output face 214 of the perforated flame holder 102. As used herein, the terms heat, heat energy, and thermal energy shall be considered synonymous unless further definition is provided. As used above, heat energy and thermal energy refer generally to the released chemical energy initially held by reactants during the combustion reaction 302. As used elsewhere herein, heat, heat energy and thermal energy correspond to a detectable temperature rise undergone by real bodies characterized by heat capacities. Under nominal operating conditions, the perforations 210 can be configured to collectively hold at least 80% of the combustion reaction 302 between the input face 212 and the output face 214 of the perforated flame holder 102. In some experiments, the inventors produced a combustion reaction 302 that was apparently wholly contained in the perforations 210 between the input face 212 and the output face 214 of the perforated flame holder 102. According to an alternative interpretation, the perforated flame holder 102 can support combustion between the input face 212 and output face 214 when combustion is "time-averaged." For example, during transients, such as before the perforated flame holder 102 is fully heated, or if too high a (cooling) load is placed on the system, the combustion may travel somewhat downstream from the output face 214 of the perforated flame holder 102. Alternatively, if the cooling load is relatively low and/or the furnace temperature reaches a high level, the combustion may travel somewhat upstream of the input face 212 of the perforated flame holder 102.

While a "flame" is described in a manner intended for ease of description, it should be understood that in some instances, no visible flame is present. Combustion occurs primarily within the perforations 210, but the "glow" of combustion heat is dominated by a visible glow of the perforated flame holder 102 itself. In other instances, the inventors have noted transient "huffing" or "flashback" wherein a visible flame momentarily ignites in a region lying between the input face 212 of the perforated flame holder 102 and the fuel nozzle 218, within the dilution region $D_D$. Such transient huffing or flashback is generally short in duration such that, on a time-averaged basis, a majority of combustion occurs within the perforations 210 of the perforated flame holder 102, between the input face 212 and the output face 214. In still other instances, the inventors have noted apparent combustion occurring downstream from the output face 214 of the perforated flame holder 102, but still a majority of combustion occurred within the perforated flame holder 102 as evidenced by continued visible glow from the perforated flame holder 102 that was observed.

The perforated flame holder 102 can be configured to receive heat from the combustion reaction 302 and output a portion of the received heat as thermal radiation 304 to heat-receiving structures (e.g., furnace walls and/or radiant section working fluid tubes) in or adjacent to the combustion volume 204. As used herein, terms such as radiation, thermal radiation, radiant heat, heat radiation, etc. are to be construed as being substantially synonymous, unless further definition is provided. Specifically, such terms refer to blackbody-type radiation of electromagnetic energy, primarily at infrared wavelengths, but also at visible wavelengths owing to elevated temperature of the perforated flame holder body 208.

Referring especially to FIG. 3, the perforated flame holder 102 outputs another portion of the received heat to the fuel and oxidant mixture 206 received at the input face 212 of the perforated flame holder 102. The perforated flame holder body 208 may receive heat from the combustion reaction 302 at least in heat receiving regions 306 of perforation walls 308. Experimental evidence has suggested to the inventors that the position of the heat receiving regions 306, or at least the position corresponding to a maximum rate of receipt of heat, can vary along the length of the perforation walls 308. In some experiments, the location of maximum receipt of heat was apparently between ⅓ and ½ of the distance from the input face 212 to the output face 214 (i.e., somewhat nearer to the input face 212 than to the output face 214). The inventors contemplate that the heat receiving regions 306 may lie nearer to the output face 214 of the perforated flame holder 102 under other conditions. Most probably, there is no clearly defined edge of the heat receiving regions 306 (or for that matter, the heat output regions 310, described below). For ease of understanding, the heat receiving regions 306 and the heat output regions 310 will be described as particular regions 306, 310.

The perforated flame holder body 208 can be characterized by a heat capacity. The perforated flame holder body 208 may hold thermal energy from the combustion reaction 302 in an amount corresponding to the heat capacity multiplied by temperature rise, and transfer the thermal energy from the heat receiving regions 306 to heat output regions 310 of the perforation walls 308. Generally, the heat output regions 310 are nearer to the input face 212 than are the heat receiving regions 306. According to one interpretation, the perforated flame holder body 208 can transfer heat from the heat receiving regions 306 to the heat output regions 310 via thermal radiation, depicted graphically as 304. According to another interpretation, the perforated flame holder body 208 can transfer heat from the heat receiving regions 306 to the heat output regions 310 via heat conduction along heat conduction paths 312. The inventors contemplate that multiple heat transfer mechanisms including conduction, radiation, and possibly convection may be operative in transferring heat from the heat receiving regions 306 to the heat output regions 310. In this way, the perforated flame holder 102 may act as a heat source to maintain the combustion reaction 302, even under conditions where a combustion reaction 302 would not be stable when supported from a conventional flame holder.

The inventors believe that the perforated flame holder 102 causes the combustion reaction 302 to begin within thermal boundary layers 314 formed adjacent to walls 308 of the perforations 210. Insofar as combustion is generally understood to include a large number of individual reactions, and since a large portion of combustion energy is released within the perforated flame holder 102, it is apparent that at least a majority of the individual reactions occur within the perforated flame holder 102. As the relatively cool fuel and oxidant mixture 206 approaches the input face 212, the flow is split into portions that respectively travel through individual perforations 210. The hot perforated flame holder body 208 transfers heat to the fluid, notably within thermal boundary layers 314 that progressively thicken as more and more heat is transferred to the incoming fuel and oxidant mixture 206. After reaching a combustion temperature (e.g., the auto-ignition temperature of the fuel), the reactants continue to flow while a chemical ignition delay time elapses, over which time the combustion reaction 302 occurs. Accordingly, the combustion reaction 302 is shown as occurring within the thermal boundary layers 314. As flow progresses, the thermal boundary layers 314 merge at a merger point 316. Ideally, the merger point 316 lies between the input face 212 and output face 214 that define the ends of the perforations 210. At some position along the length of a perforation 210, the combustion reaction 302 outputs more heat to the perforated flame holder body 208 than it receives from the perforated flame holder body 208. The heat is received at the heat receiving region 306, is held by the perforated flame holder body 208, and is transported to the heat output region 310 nearer to the input face 212, where the heat is transferred into the cool reactants (and any included diluent) to bring the reactants to the ignition temperature.

In an embodiment, each of the perforations 210 is characterized by a length L defined as a reaction fluid propagation path length between the input face 212 and the output face 214 of the perforated flame holder 102. As used herein, the term reaction fluid refers to matter that travels through a perforation 210. Near the input face 212, the reaction fluid includes the fuel and oxidant mixture 206 (optionally including nitrogen, flue gas, and/or other "non-reactive" species). Within the combustion reaction region, the reaction fluid may include plasma associated with the combustion reaction 302, molecules of reactants and their constituent parts, any non-reactive species, reaction intermediates (including transition states), and reaction products. Near the output face 214, the reaction fluid may include reaction products and byproducts, non-reactive gas, and excess oxidant.

The plurality of perforations 210 can be each characterized by a transverse dimension D between opposing perforation walls 308. The inventors have found that stable combustion can be maintained in the perforated flame holder 102 if the length L of each perforation 210 is at least four times the transverse dimension D of the perforation. In other embodiments, the length L can be greater than six times the transverse dimension D. For example, experiments have been run where L is at least eight, at least twelve, at least sixteen, and at least twenty-four times the transverse dimension D. Preferably, the length L is sufficiently long for thermal boundary layers 314 to form adjacent to the perforation walls 308 in a reaction fluid flowing through the perforations 210 to converge at merger points 316 within the perforations 210 between the input face 212 and the output face 214 of the perforated flame holder 102. In experiments, the inventors have found L/D ratios between 12 and 48 to work well (i.e., produce low NOx, produce low CO, and maintain stable combustion).

The perforated flame holder body 208 can be configured to convey heat between adjacent perforations 210. The heat conveyed between adjacent perforations 210 can be selected to cause heat output from the combustion reaction portion 302 in a first perforation 210 to supply heat to stabilize a combustion reaction portion 302 in an adjacent perforation 210.

Referring especially to FIG. 2, the fuel and oxidant source 202 can further include a fuel nozzle 218, configured to output fuel, and an oxidant source 220 configured to output a fluid including the oxidant. For example, the fuel nozzle 218 can be configured to output pure fuel. The oxidant source 220 can be configured to output combustion air carrying oxygen, and optionally, flue gas.

The perforated flame holder 102 can be held by a perforated flame holder support structure 222 configured to hold the perforated flame holder 102 at a dilution distance $D_D$ away from the fuel nozzle 218. The fuel nozzle 218 can be configured to emit a fuel jet selected to entrain the oxidant to form the fuel and oxidant mixture 206 as the fuel jet and oxidant travel along a path to the perforated flame holder 102 through the dilution distance $D_D$ between the fuel nozzle 218 and the perforated flame holder 102. Additionally or alternatively (particularly when a blower is used to deliver oxidant contained in combustion air), the oxidant or combustion air source can be configured to entrain the fuel and the fuel and oxidant travel through the dilution distance $D_D$. In some embodiments, a flue gas recirculation path 224 can be provided. Additionally or alternatively, the fuel nozzle 218 can be configured to emit a fuel jet selected to entrain the oxidant and to entrain flue gas as the fuel jet travels through the dilution distance $D_D$ between the fuel nozzle 218 and the input face 212 of the perforated flame holder 102.

The fuel nozzle 218 can be configured to emit the fuel through one or more fuel orifices 226 having an inside diameter dimension that is referred to as "nozzle diameter." The perforated flame holder support structure 222 can support the perforated flame holder 102 to receive the fuel and oxidant mixture 206 at the distance $D_D$ away from the fuel nozzle 218 greater than 20 times the nozzle diameter. In another embodiment, the perforated flame holder 102 is disposed to receive the fuel and oxidant mixture 206 at the distance $D_D$ away from the fuel nozzle 218 between 100 times and 1100 times the nozzle diameter. Preferably, the perforated flame holder support structure 222 is configured to hold the perforated flame holder 102 at a distance about 200 times or more of the nozzle diameter away from the fuel nozzle 218. When the fuel and oxidant mixture 206 travels about 200 times the nozzle diameter or more, the mixture is sufficiently homogenized to cause the combustion reaction 302 to produce minimal NOx.

The fuel and oxidant source 202 can alternatively include a premix fuel and oxidant source, according to an embodiment. A premix fuel and oxidant source can include a premix chamber (not shown), a fuel nozzle configured to output fuel into the premix chamber, and an oxidant (e.g., combustion air) channel configured to output the oxidant into the premix chamber. A flame arrestor can be disposed between the premix fuel and oxidant source and the perforated flame holder 102 and be configured to prevent flame flashback into the premix fuel and oxidant source.

The oxidant source 220, whether configured for entrainment, such as in the case of an educator, in the combustion volume 204 or for premixing, can include a blower or a compressor configured to force the oxidant through the fuel and oxidant source 202.

The support structure 222 can be configured to support the perforated flame holder 102 from a floor or wall (not shown) of the combustion volume 204, for example. In another embodiment, the support structure 222 supports the perforated flame holder 102 from the fuel and oxidant source 202. Alternatively, the support structure 222 can suspend the perforated flame holder 102 from an overhead structure (such as a flue, in the case of an up-fired system). The support structure 222 can support the perforated flame holder 102 in various orientations and directions.

The perforated flame holder 102 can include a single perforated flame holder body 208. In another embodiment, the perforated flame holder 102 can include a plurality of adjacent perforated flame holder sections that collectively provide a tiled perforated flame holder 102.

The perforated flame holder support structure 222 can be configured to support the plurality of perforated flame holder sections. The perforated flame holder support structure 222 can include a metal superalloy, a cementatious, and/or ceramic refractory material. In an embodiment, the plurality of adjacent perforated flame holder sections can be joined with a fiber reinforced refractory cement.

The perforated flame holder 102 can have a width dimension W between opposite sides of the peripheral surface 216 at least twice a thickness dimension T between the input face 212 and the output face 214. In another embodiment, the perforated flame holder 102 can have a width dimension W between opposite sides of the peripheral surface 216 at least three times, at least six times, or at least nine times the thickness dimension T between the input face 212 and the output face 214 of the perforated flame holder 102.

In an embodiment, the perforated flame holder 102 can have a width dimension W less than a width of the combustion volume 204. This can allow the flue gas circulation path 224 from above to below the perforated flame holder 102 to lie between the peripheral surface 216 of the perforated flame holder 102 and the combustion volume wall (not shown).

Referring again to both FIGS. 2 and 3, the perforations 210 can be of various shapes. In an embodiment, the perforations 210 can include elongated squares, each having a transverse dimension D between opposing sides of the squares. In another embodiment, the perforations 210 can include elongated hexagons, each having a transverse dimension D between opposing sides of the hexagons. In yet another embodiment, the perforations 210 can include hollow cylinders, each having a transverse dimension D corresponding to a diameter of the cylinder. In another embodiment, the perforations 210 can include truncated cones or truncated pyramids (e.g., frustums), each having a transverse dimension D radially symmetric relative to a length axis that extends from the input face 212 to the output face 214. In some embodiments, the perforations 210 can each have a lateral dimension D equal to or greater than a quenching distance of the flame based on standard reference conditions. Alternatively, the perforations 210 may have lateral dimension D less then than a standard reference quenching distance.

In one range of embodiments, each of the plurality of perforations 210 has a lateral dimension D between 0.05 inch and 1.0 inch. Preferably, each of the plurality of perforations 210 has a lateral dimension D between 0.1 inch and 0.5 inch. For example, the plurality of perforations 210 can each have a lateral dimension D of about 0.2 to 0.4 inch.

The void fraction of a perforated flame holder 102 is defined as the total volume of all perforations 210 in a section of the perforated flame holder 102 divided by a total volume of the perforated flame holder 102 including body 208 and perforations 210. The perforated flame holder 102 should have a void fraction between 0.10 and 0.90. In an embodiment, the perforated flame holder 102 can have a void fraction between 0.30 and 0.80. In another embodiment, the perforated flame holder 102 can have a void fraction of about 0.70. Using a void fraction of about 0.70 was found to be especially effective for producing very low NOx.

The perforated flame holder 102 can be formed from a fiber reinforced cast refractory material and/or a refractory material such as an aluminum silicate material. For example, the perforated flame holder 102 can be formed to include mullite or cordierite. Additionally or alternatively, the perforated flame holder body 208 can include a metal superalloy such as Inconel or Hastelloy. The perforated flame holder body 208 can define a honeycomb. Honeycomb is an industrial term of art that need not strictly refer to a hexagonal cross section and most usually includes cells of square cross section. Honeycombs of other cross sectional areas are also known.

The inventors have found that the perforated flame holder 102 can be formed from VERSAGRID® ceramic honeycomb, available from Applied Ceramics, Inc. of Doraville, S.C.

The perforations 210 can be parallel to one another and normal to the input and output faces 212, 214. In another embodiment, the perforations 210 can be parallel to one another and formed at an angle relative to the input and output faces 212, 214. In another embodiment, the perforations 210 can be non-parallel to one another. In another embodiment, the perforations 210 can be non-parallel to one another and non-intersecting. In another embodiment, the perforations 210 can be intersecting. The body 208 can be one piece or can be formed from a plurality of sections.

In another embodiment, which is not necessarily preferred, the perforated flame holder 102 may be formed from reticulated ceramic material. The term "reticulated" refers to a netlike structure. Reticulated ceramic material is often made by dissolving a slurry into a sponge of specified porosity, allowing the slurry to harden, and burning away the sponge and curing the ceramic.

In another embodiment, which is not necessarily preferred, the perforated flame holder 102 may be formed from a ceramic material that has been punched, bored or cast to create channels.

In another embodiment, the perforated flame holder 102 can include a plurality of tubes or pipes bundled together. The plurality of perforations 210 can include hollow cylinders and can optionally also include interstitial spaces between the bundled tubes. In an embodiment, the plurality of tubes can include ceramic tubes. Refractory cement can be included between the tubes and configured to adhere the tubes together. In another embodiment, the plurality of tubes can include metal (e.g., superalloy) tubes. The plurality of tubes can be held together by a metal tension member circumferential to the plurality of tubes and arranged to hold the plurality of tubes together. The metal tension member can include stainless steel, a superalloy metal wire, and/or a superalloy metal band.

The perforated flame holder body 208 can alternatively include stacked perforated sheets of material, each sheet having openings that connect with openings of subjacent and superjacent sheets. The perforated sheets can include perforated metal sheets, ceramic sheets and/or expanded sheets. In another embodiment, the perforated flame holder body 208 can include discontinuous packing bodies such that the perforations 210 are formed in the interstitial spaces between the discontinuous packing bodies. In one example, the discontinuous packing bodies include structured packing shapes. In another example, the discontinuous packing bodies include random packing shapes. For example, the discontinuous packing bodies can include ceramic Raschig ring, ceramic Berl saddles, ceramic Intalox saddles, and/or metal rings or other shapes (e.g. Super Raschig Rings) that may be held together by a metal cage.

The inventors contemplate various explanations for why burner systems including the perforated flame holder 102 provide such clean combustion.

According to an embodiment, the perforated flame holder 102 may act as a heat source to maintain a combustion reaction 302 even under conditions where a combustion reaction 302 would not be stable when supported by a conventional flame holder. This capability can be leveraged to support combustion using a leaner fuel-to-oxidant mixture than is typically feasible. Thus, according to an embodiment, at the point where the fuel stream 206 contacts the input face 212 of the perforated flame holder 102, an average fuel-to-oxidant ratio of the fuel stream 206 is below a (conventional) lower combustion limit of the fuel component of the fuel stream 206—lower combustion limit defines the lowest concentration of fuel at which a fuel and oxidant mixture 206 will burn when exposed to a momentary ignition source under normal atmospheric pressure and an ambient temperature of 25° C. (77° F.).

The perforated flame holder 102 and systems including the perforated flame holder 102 described herein were found to provide substantially complete combustion of CO (single digit ppm down to undetectable, depending on experimental conditions), while supporting low NOx. According to one interpretation, such a performance can be achieved due to a sufficient mixing used to lower peak flame temperatures (among other strategies). Flame temperatures tend to peak under slightly rich conditions, which can be evident in any diffusion flame that is insufficiently mixed. By sufficiently mixing, a homogenous and slightly lean mixture can be achieved prior to combustion. This combination can result in reduced flame temperatures, and thus reduced NOx formation. According to an embodiment, "slightly lean" may refer to 3% $O_2$, i.e. an equivalence ratio of ~0.87. Use of even leaner mixtures is possible, but may result in elevated levels of $O_2$. Moreover, the inventors believe perforation walls 308 may act as a heat sink for the combustion fluid. This effect may alternatively or additionally reduce combustion temperatures and lower NOx.

According to another interpretation, production of NOx can be reduced if the combustion reaction 302 occurs over a very short duration of time. Rapid combustion causes the reactants (including oxygen and entrained nitrogen) to be exposed to NOx-formation temperature for a time too short for NOx formation kinetics to cause significant production of NOx. The time required for the reactants to pass through the perforated flame holder 102 is very short compared to a conventional flame. The low NOx production associated with perforated flame holder combustion may thus be related to the short duration of time required for the reactants (and entrained nitrogen) to pass through the perforated flame holder 102.

Figure 4:
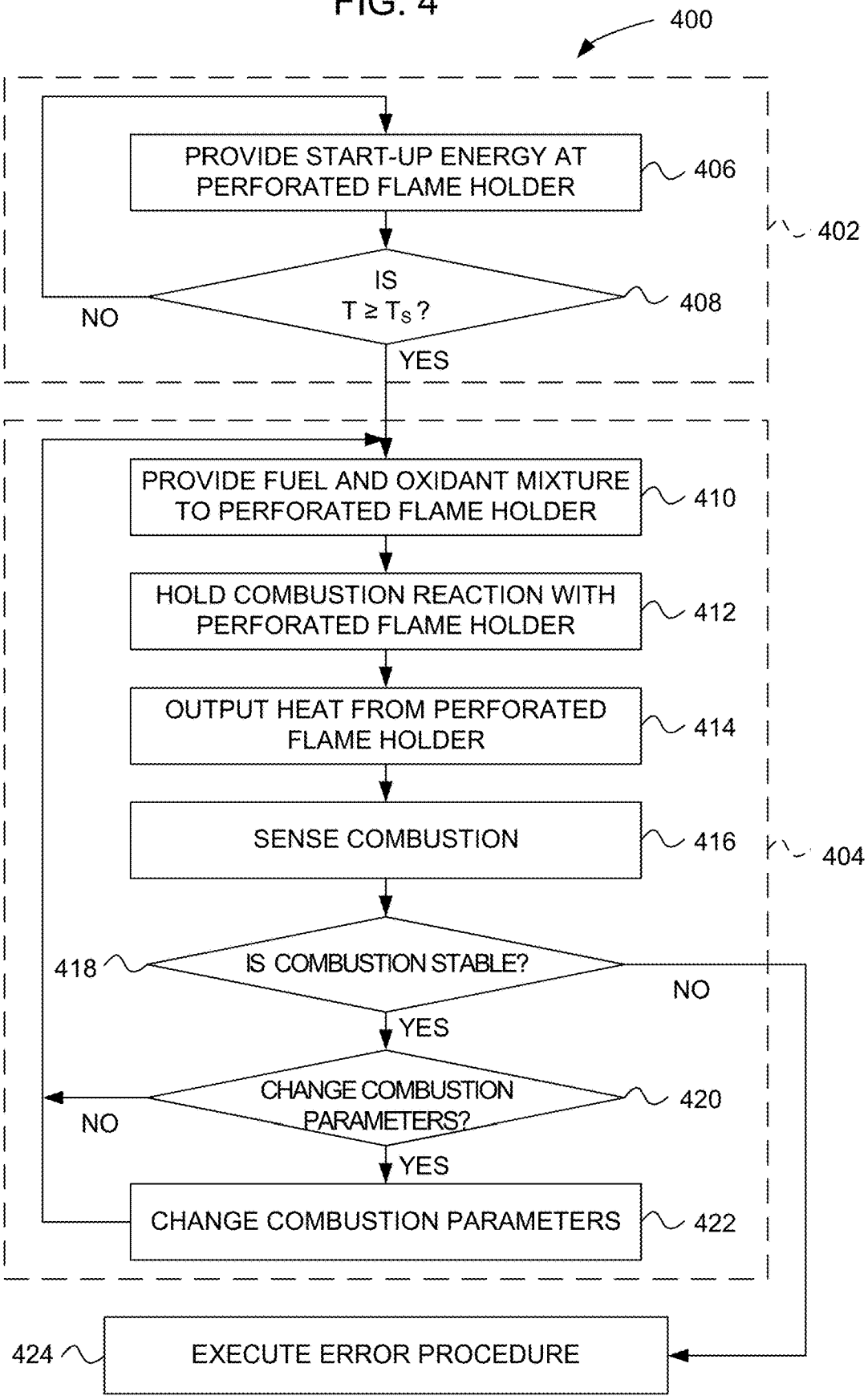
FIG. 4 is a flow chart showing a method for operating a burner system including the perforated flame holder of FIGS. 1-3, according to an embodiment.

FIG. 4 is a flow chart showing a method 400 for operating a burner system including the perforated flame holder shown and described herein. To operate a burner system including a perforated flame holder, the perforated flame holder is first heated to a temperature sufficient to maintain combustion of the fuel and oxidant mixture.

According to a simplified description, the method 400 begins with step 402, wherein the perforated flame holder is preheated to a start-up temperature, $T_S$. After the perforated flame holder is raised to the start-up temperature, the method proceeds to step 404, wherein the fuel and oxidant are provided to the perforated flame holder and combustion is held by the perforated flame holder.

According to a more detailed description, step 402 begins with step 406, wherein start-up energy is provided at the perforated flame holder. Simultaneously or following providing start-up energy, a decision step 408 determines whether the temperature T of the perforated flame holder is at or above the start-up temperature, $T_S$. As long as the temperature of the perforated flame holder is below its start-up temperature, the method loops between steps 406 and 408 within the preheat step 402. In step 408, if the temperature T of at least a predetermined portion of the perforated flame holder is greater than or equal to the start-up temperature, the method 400 proceeds to overall step 404, wherein fuel and oxidant is supplied to and combustion is held by the perforated flame holder.

Step 404 may be broken down into several discrete steps, at least some of which may occur simultaneously.

Proceeding from step 408, a fuel and oxidant mixture is provided to the perforated flame holder, as shown in step 410. The fuel and oxidant may be provided by a fuel and oxidant source that includes a separate fuel nozzle and oxidant (e.g., combustion air) source, for example. In this approach, the fuel and oxidant are output in one or more directions selected to cause the fuel and oxidant mixture to be received by the input face of the perforated flame holder. The fuel may entrain the combustion air (or alternatively, the combustion air may dilute the fuel) to provide a fuel and oxidant mixture at the input face of the perforated flame holder at a fuel dilution selected for a stable combustion reaction that can be held within the perforations of the perforated flame holder.

Proceeding to step 412, the combustion reaction is held by the perforated flame holder.

In step 414, heat may be output from the perforated flame holder. The heat output from the perforated flame holder may be used to power an industrial process, heat a working fluid, generate electricity, or provide motive power, for example.

In optional step 416, the presence of combustion may be sensed. Various sensing approaches have been used and are contemplated by the inventors. Generally, combustion held by the perforated flame holder is very stable and no unusual sensing requirement is placed on the system. Combustion sensing may be performed using an infrared sensor, a video sensor, an ultraviolet sensor, a charged species sensor, thermocouple, thermopile, flame rod, and/or other combustion sensing apparatuses. In an additional or alternative variant of step 416, a pilot flame or other ignition source may be provided to cause ignition of the fuel and oxidant mixture in the event combustion is lost at the perforated flame holder.

Proceeding to decision step 418, if combustion is sensed not to be stable, the method 400 may exit to step 424, wherein an error procedure is executed. For example, the error procedure may include turning off fuel flow, re-executing the preheating step 402, outputting an alarm signal, igniting a stand-by combustion system, or other steps. If, in step 418, combustion in the perforated flame holder is determined to be stable, the method 400 proceeds to decision step 420, wherein it is determined if combustion parameters should be changed. If no combustion parameters are to be changed, the method loops (within step 404) back to step 410, and the combustion process continues. If a change in combustion parameters is indicated, the method 400 proceeds to step 422, wherein the combustion parameter change is executed. After changing the combustion parameter(s), the method loops (within step 404) back to step 410, and combustion continues.

Combustion parameters may be scheduled to be changed, for example, if a change in heat demand is encountered. For example, if less heat is required (e.g., due to decreased electricity demand, decreased motive power requirement, or lower industrial process throughput), the fuel and oxidant flow rate may be decreased in step 422. Conversely, if heat demand is increased, then fuel and oxidant flow may be increased. Additionally or alternatively, if the combustion system is in a start-up mode, then fuel and oxidant flow may be gradually increased to the perforated flame holder over one or more iterations of the loop within step 404.

Referring again to FIG. 2, the burner system 200 includes a heater 228 operatively coupled to the perforated flame holder 102. As described in conjunction with FIGS. 3 and 4, the perforated flame holder 102 operates by outputting heat to the incoming fuel and oxidant mixture 206. After combustion is established, this heat is provided by the combustion reaction 302; but before combustion is established, the heat is provided by the heater 228.

Various heating apparatuses have been used and are contemplated by the inventors. In some embodiments, the heater 228 can include a flame holder configured to support a flame disposed to heat the perforated flame holder 102. The fuel and oxidant source 202 can include a fuel nozzle 218 configured to emit a fuel stream 206 and an oxidant source 220 configured to output oxidant (e.g., combustion air) adjacent to the fuel stream 206. The fuel nozzle 218 and oxidant source 220 can be configured to output the fuel stream 206 to be progressively diluted by the oxidant (e.g., combustion air). The perforated flame holder 102 can be disposed to receive a diluted fuel and oxidant mixture 206 that supports a combustion reaction 302 that is stabilized by the perforated flame holder 102 when the perforated flame holder 102 is at an operating temperature. A start-up flame holder, in contrast, can be configured to support a start-up flame at a location corresponding to a relatively unmixed fuel and oxidant mixture that is stable without stabilization provided by the heated perforated flame holder 102.

The burner system 200 can further include a controller 110 operatively coupled to the heater 228 and to a data interface 232. For example, the controller 110 can be configured to control a start-up flame holder actuator configured to cause the start-up flame holder to hold the start-up flame when the perforated flame holder 102 needs to be pre-heated and to not hold the start-up flame when the perforated flame holder 102 is at an operating temperature (e.g., when $T \geq T_S$).

Various approaches for actuating a start-up flame are contemplated. According to an embodiment, the start-up flame holder includes a mechanically-actuated bluff body configured to be actuated to intercept the fuel and oxidant mixture 206 to cause heat-recycling and/or stabilizing vortices and thereby hold a start-up flame; or to be actuated to not intercept the fuel and oxidant mixture 206 to cause the fuel and oxidant mixture 206 to proceed to the perforated flame holder 102. In another embodiment, a fuel control valve, blower, and/or damper may be used to select a fuel and oxidant mixture flow rate that is sufficiently low for a start-up flame to be jet-stabilized; and upon reaching a perforated flame holder 102 operating temperature, the flow rate may be increased to "blow out" the start-up flame. In another embodiment, the heater 228 may include an electrical power supply operatively coupled to the controller 110 and configured to apply an electrical charge or voltage to the fuel and oxidant mixture 206. An electrically conductive start-up flame holder may be selectively coupled to a voltage ground or other voltage selected to attract the electrical charge in the fuel and oxidant mixture 206. The attraction of the electrical charge was found by the inventors to cause a start-up flame to be held by the electrically conductive start-up flame holder.

In another embodiment, the heater 228 may include an electrical resistance heater configured to output heat to the perforated flame holder 102 and/or to the fuel and oxidant mixture 206. The electrical resistance heater 228 can be configured to heat up the perforated flame holder 102 to an operating temperature. The heater 228 can further include a power supply and a switch operable, under control of the controller 110, to selectively couple the power supply to the electrical resistance heater 228.

An electrical resistance heater 228 can be formed in various ways. For example, the electrical resistance heater 228 can be formed from KANTHAL® wire (available from Sandvik Materials Technology division of Sandvik AB of Hallstahammar, Sweden) threaded through at least a portion of the perforations 210 defined by the perforated flame holder body 208. Alternatively, the heater 228 can include an inductive heater, a high-energy beam heater (e.g. microwave or laser), a frictional heater, electro-resistive ceramic coatings, or other types of heating technologies.

Other forms of start-up apparatuses are contemplated. For example, the heater 228 can include an electrical discharge igniter or hot surface igniter configured to output a pulsed ignition to the oxidant and fuel. Additionally or alternatively, a start-up apparatus can include a pilot flame apparatus disposed to ignite the fuel and oxidant mixture 206 that would otherwise enter the perforated flame holder 102. The electrical discharge igniter, hot surface igniter, and/or pilot flame apparatus can be operatively coupled to the controller 110, which can cause the electrical discharge igniter or pilot flame apparatus to maintain combustion of the fuel and oxidant mixture 206 in or upstream from the perforated flame holder 102 before the perforated flame holder 102 is heated sufficiently to maintain combustion.

The burner system 200 can further include a sensor 234 operatively coupled to the controller 110. The sensor 234 can include a heat sensor configured to detect infrared radiation or a temperature of the perforated flame holder 102. The controller 110 can be configured to control the heating apparatus 228 responsive to input from the sensor 234. Optionally, a fuel control valve 236 can be operatively coupled to the controller 110 and configured to control a flow of fuel to the fuel and oxidant source 202. Additionally or alternatively, an oxidant blower or damper 238 can be operatively coupled to the controller 110 and configured to control flow of the oxidant (or combustion air).

The sensor 234 can further include a combustion sensor operatively coupled to the controller 110, the combustion sensor 234 being configured to detect a temperature, video image, and/or spectral characteristic of a combustion reaction 302 held by the perforated flame holder 102. The fuel control valve 236 can be configured to control a flow of fuel from a fuel source to the fuel and oxidant source 202. The controller 110 can be configured to control the fuel control valve 236 responsive to input from the combustion sensor 234. The controller 110 can be configured to control the fuel control valve 236 and/or oxidant blower or damper 238 to control a preheat flame type of heater 228 to heat the perforated flame holder 102 to an operating temperature. The controller 110 can similarly control the fuel control valve 236 and/or the oxidant blower or damper 238 to change the fuel and oxidant mixture 206 flow responsive to a heat demand change received as data via the data interface 232.

Figure 5A:
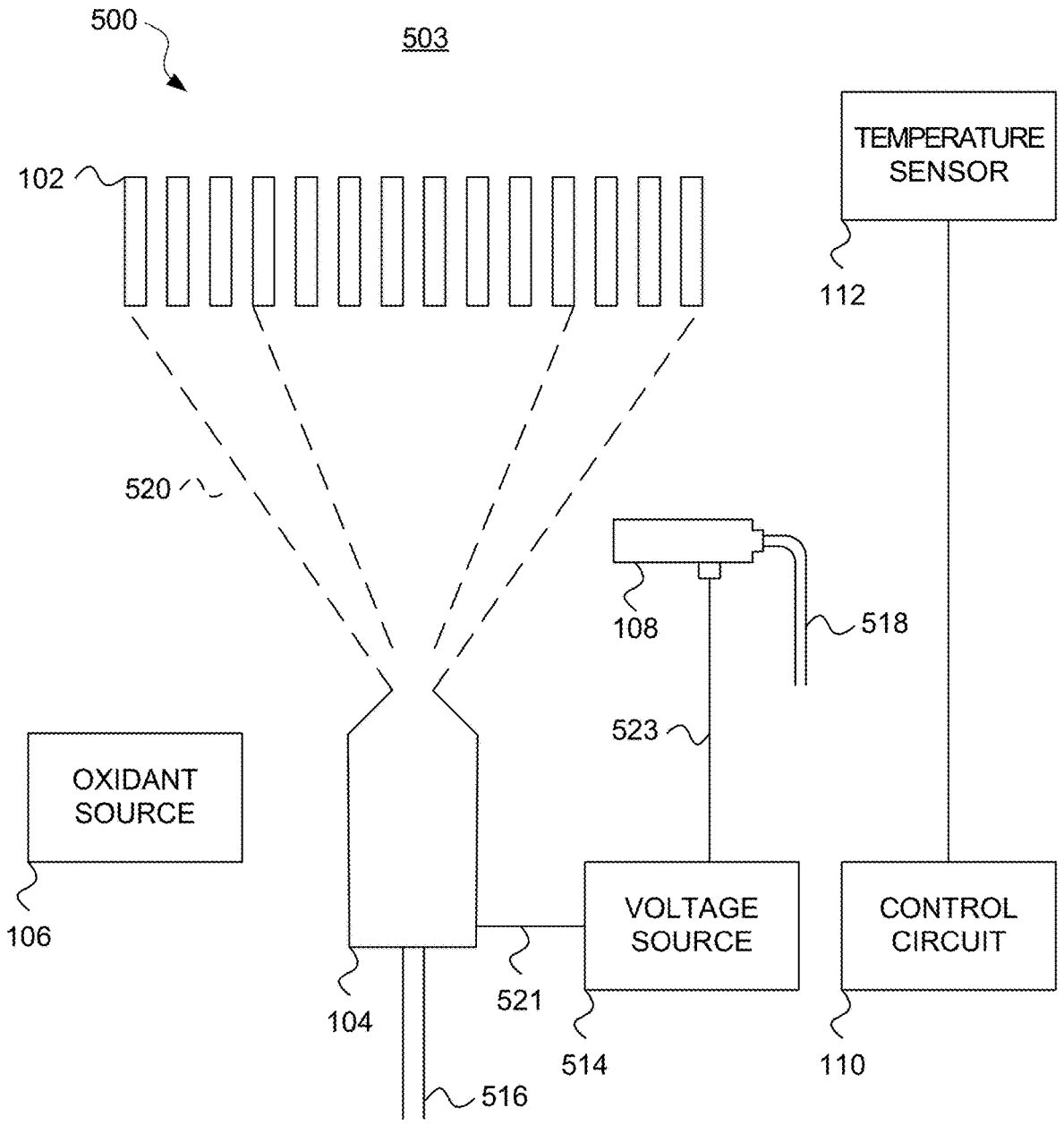
FIG. 5A is a diagram of a combustion system, according to one embodiment.

FIG. 5A is a diagram of a combustion system 500, according to one embodiment. The combustion system 500 includes a perforated flame holder 102 and a fuel nozzle 104 positioned in a furnace volume 503. The combustion system 500 also includes an oxidant source 106 and a plasma ignition device 108 positioned adjacent to the fuel nozzle 104. The combustion system 500 further includes a voltage source 514 and a temperature sensor 112 positioned adjacent to the perforated flame holder 102. A controller 110 is coupled to the temperature sensor 112.

According to an embodiment, the fuel nozzle 104 is configured to output a first fuel stream 520 including a first fuel toward the perforated flame holder 102. A fuel line 516 supplies the first fuel to the fuel nozzle 104. The oxidant source 106 introduces an oxidant into the furnace volume 503. As the fuel stream 520 travels toward the perforated flame holder 102, the fuel stream 520 entrains the oxidant supplied by the oxidant source 106.

According to an embodiment, the combustion system 500 operates in a preheating state and in a standard operating state. In the preheating state, the combustion system 500 preheats the perforated flame holder 102 to a threshold temperature. When the perforated flame holder 102 has reached the threshold temperature, the combustion system 500 enters the standard operating condition in which the perforated flame holder 102 supports a combustion reaction of the first fuel and oxidant within the perforated flame holder 102.

According to an embodiment, the parameters of the fuel stream 520 are selected such that a stable combustion reaction of the first fuel and the oxidant will not be supported in a position between the fuel nozzle 104 and the perforated flame holder 102 under standard operating conditions. For example, the flow rate, the velocity, the trajectory, the dispersion, and/or other characteristics of the fuel stream 520 can be selected such that combustion of the first fuel and the oxidant cannot be stably supported between the perforated flame holder 102 and the fuel nozzle 104 under standard operating conditions.

According to an embodiment, in the preheating state the plasma ignition device 108 outputs a plasma adjacent to the first fuel stream 520. The plasma interacts with the first fuel stream 520 and causes the first fuel and oxidant 206 to combust at a location between the fuel nozzle 104 and the perforated flame holder 102. In particular, the output of the plasma from the plasma ignition device 108 causes the first fuel stream 520 to support a preheating flame of the first fuel and oxidant 206 at a position between the fuel nozzle 104 and the perforated flame holder 102. Absent the energizing effect of the plasma, the first fuel stream 520 will not stably support a combustion reaction 302 of the first fuel and oxidant 206 at a position between the fuel nozzle 104 and the perforated flame holder 102.

According to an embodiment, the combustion system 500 utilizes the voltage source 514 to cause the plasma ignition device 108 to generate the plasma. In the preheating state the voltage source 514 is configured to apply a high voltage between a first electrode and a second electrode. In particular, the voltage source 514 applies the high voltage by applying a first voltage to the first electrode via a first electrical connection 521 and by applying a second voltage to the second electrode via a second electrical connection 523. At the same time, a fluid line 518 supplies a fluid to the plasma ignition device 108. The application of the high voltage causes the plasma ignition device 108 to generate a plasma from the fluid. The plasma ignition device 108 outputs the plasma adjacent to the fuel stream 520.

According to an embodiment, the first electrode can include a conductive portion of the fuel nozzle 104, an electrode positioned adjacent to the fuel nozzle 104, an electrode positioned within the plasma ignition device 108, or a portion of the plasma ignition device 108. The first voltage can include ground. The second electrode can include an electrode positioned within the plasma ignition device 108 or a conductive portion of the plasma ignition device 108. Alternatively, the first and second electrodes can both be part of the plasma ignition device 108. In an example in which both the first electrode and the second electrode are part of the plasma ignition device 108, the first and second electrodes can be electrically insulated from each other.

According to an embodiment, the high voltage is between 1000 V and 50,000 V. The controller 110 can cause the plasma ignition device 108 to output a plasma by controlling the voltage source 514 to apply the first and second voltages on the first and second electrical connections 521, 523.

According to an embodiment, the plasma ignition device 108 is coupled to a fluid line 518 that supplies an input fluid to the plasma ignition device 108. When the controller 110 causes the voltage source 514 to output the first and second voltages on the first and second electrical connections 521, 523, the plasma ignition device 108 generates a plasma from the input fluid. The plasma ignition device 108 can output the plasma from the plasma ignition device 108 toward the fuel stream 520. When the plasma impinges on the fuel stream 520, the plasma can cause the fuel stream 520 to combust. If a steady stream of plasma is emitted from the plasma ignition device 108 onto the fuel stream 520, then a stable combustion reaction 302 of the first fuel and oxidant 206 can be supported at a position between the fuel nozzle 104 and the perforated flame holder 102.

According to an embodiment, the plasma ignition device 108 generates a series of sparks at the second electrode. In one example, the plasma ignition device 108 can generate more than 10,000 sparks per second. According to an embodiment, each spark can generate plasma from the input fluid.

According to an embodiment, the fluid line 518 supplies air to the plasma ignition device 108. The air can contain molecular oxygen ($O_2$) and molecular nitrogen ($N_2$). When the voltage source 514 applies the first and second voltages to the first and second electrical connections 521 and 523 respectively, the plasma ignition device 108 generates a rapid succession of sparks that in turn generate from the air a plasma that includes atomic oxygen and/or atomic nitrogen. The atomic oxygen and/or atomic nitrogen react in a highly energetic manner with the first fuel in the fuel stream 520. The reaction between the atomic oxygen and/or nitrogen and the first fuel can generate high amounts of energy that result in a combustion reaction 302 of the first fuel and oxidant 206 at a position between the fuel nozzle 104 and the perforated flame holder 102. If the plasma ignition device 108 outputs a steady flow of plasma, then a stable combustion reaction 302 of the first fuel and oxidant 206 can be sustained at a position between the fuel nozzle 104 and the perforated flame holder 102.

According to an embodiment, the fluid line 518 supplies a mixture of air and a second fuel to the plasma ignition device 108. When the voltage source 514 applies the first and second voltages to the first and second electrical connections 521 and 523 respectively, the plasma ignition device 108 produces a rapid succession of sparks that in turn generate from the air in the fuel and air mixture 206 a plasma that includes atomic oxygen and/or atomic nitrogen. The plasma can also include energetic electrons. The energetic electrons can contribute to the formation of the atomic oxygen and/or atomic nitrogen from molecules. The atomic oxygen and/or atomic nitrogen reacts with the second fuel, thereby causing combustion of the second fuel with the air. The plasma ignition device 108 therefore outputs a plasma that can include atomic oxygen and/or atomic nitrogen as well as a flame from the combustion of the second fuel and air 206. The plasma reacts in a highly energetic manner with the first fuel in the fuel stream 520. The reaction between the plasma and the first fuel can generate high amounts of energy that can cause a combustion reaction 302 of the first fuel and oxidant 206 at a position between the fuel nozzle 104 and the perforated flame holder 102. If the plasma ignition device 108 outputs a steady flow of plasma, then a stable combustion reaction 302 of the first fuel and oxidant 206 can be sustained at a position between the fuel nozzle 104 and the perforated flame holder 102.

According to an embodiment, each time the plasma ignition device 108 generates a spark, the plasma ignition device 108 causes unstable and temporary combustion of the second fuel and some of the atomic oxygen. The flow of the input fluid is such that a stable combustion reaction 302 of the second fuel and the air and/or oxygen radicals cannot be stably supported. Thus, each time the plasma ignition device 108 generates a spark, the plasma ignition device 108 reignites a flame from the second fuel and the air and/or oxygen radicals. The plasma stream can include the atomic oxygen, atomic nitrogen, flames, and other heated gases output from the plasma ignition device 108.

According to an embodiment, the mixture of the second fuel and air 206 can be fuel rich. In other words, the concentration of fuel relative to the air can be high enough that, in conjunction with the other characteristics of the flow of the mixture 206 of the second fuel and air, a steady combustion reaction 302 of the second fuel and air 206 will not occur within the plasma ignition device 108.

According to an embodiment, the fluid line 518 can supply to the plasma ignition device 108 the input fluid from which the plasma ignition device 108 can generate and output the plasma. The input fluid can include an inert gas, air, fuel, a mixture of fuel and air, or any suitable fluid for generating a plasma.

Figure 5B:
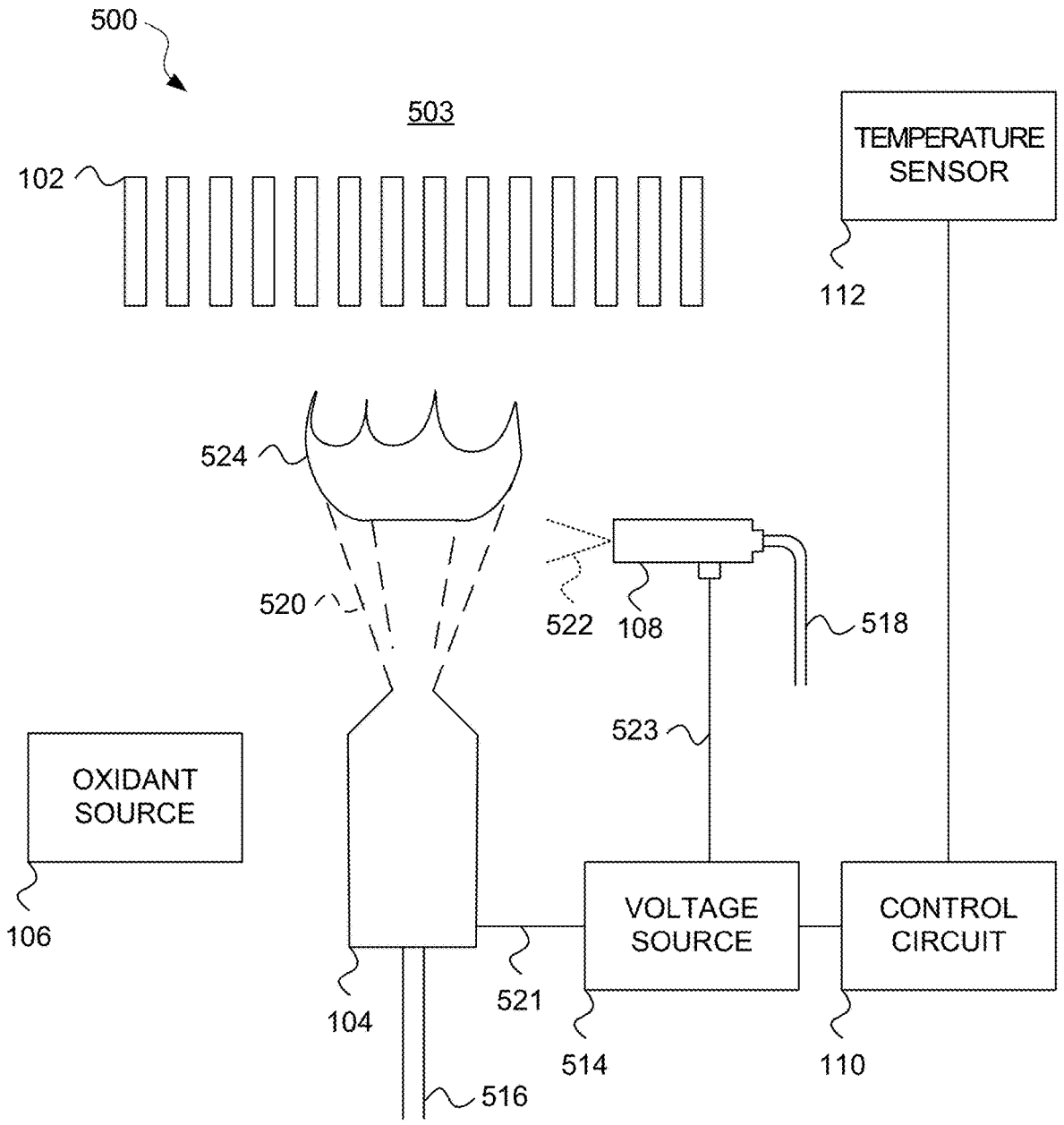
FIG. 5B is a diagram of the combustion system of FIG. 5A in a preheating state, according to an embodiment.

FIG. 5B is a diagram of the combustion system 500 of FIG. 5A in a preheating state. In the preheating state the combustion system 500 preheats the perforated flame holder 102 to a threshold temperature at which the perforated flame holder 102 can sustain a stable combustion reaction 302 of the first fuel and oxidant 206 within the perforated flame holder 102.

According to an embodiment, in the preheating state the controller 110 causes the voltage source 514 to apply the first voltage to the first electrode via the first electrical connection 521. The controller 110 also causes the voltage source 514 to apply the second voltage to the second electrode via the second electrical connection 523. The high voltage between the first and second electrodes produces a series of sparks within the plasma ignition device 108.

The fluid line 518 supplies an input fluid to the plasma ignition device 108. As described previously, the input fluid can include air, a mixture of air and the second fuel, or another fluid. The series of sparks generate a plasma from the input fluid. The plasma ignition device 108 outputs a plasma stream 522.

According to an embodiment, in the preheating state the fuel line 516 supplies a first fuel to the fuel nozzle 104. The fuel nozzle 104 outputs a fuel stream 520 including the first fuel toward the perforated flame holder 102.

According to an embodiment, the plasma ignition device 108 outputs the plasma stream 522 into the fuel stream 520. The high-energy plasma in the plasma stream 522 causes a combustion reaction 302 of the first fuel and oxidant 206 at a position between the perforated flame holder 102 and the fuel nozzle 104. In particular, the plasma stream 522 generates a preheating flame 524 which is a stable combustion reaction of the first fuel and oxidant 206 at a position between the fuel nozzle 104 and the perforated flame holder 102.

According to an embodiment, the preheating flame 524 is positioned such that the preheating flame 524 heats the perforated flame holder 102. The preheating flame 524 heats the perforated flame holder 102 until the perforated flame holder 102 has reached a threshold temperature at which the perforated flame holder 102 can stably support a combustion reaction 302 of the first fuel and oxidant 206 within the perforated flame holder 102. Once the perforated flame holder 102 has reached the threshold temperature, the combustion system 500 transitions from the preheating state to a standard operating state.

According to an embodiment, the combustion system 500 transitions from the preheating state to the standard operating state by causing the plasma ignition device 108 to cease outputting the plasma stream 522. This can be accomplished by causing the voltage source 514 to cease outputting the first and second voltages and/or by ceasing the flow of the input fluid through the fluid line 518 to the plasma ignition device 108.

According to an embodiment, the temperature sensor 112 detects the temperature of the perforated flame holder 102 and passes a temperature signal indicating the temperature of the perforated flame holder 102 to the controller 110. The controller 110 receives the temperature signal. When the controller 110 detects that the perforated flame holder 102 has reached the threshold temperature, the controller 110 causes the voltage source 514 to cease applying the first and second voltages to the first and second electrical connections 521, 523. This in turn causes the plasma ignition device 108 to cease outputting the plasma stream 522.

According to an embodiment, the combustion system 500 transitions from the preheating state to the standard operating state under the control of a technician. In particular, the technician can view the temperature of the perforated flame holder 102 on the display or by directly viewing the perforated flame holder 102. When the technician determines that the perforated flame holder 102 has reached the threshold temperature, the technician can cause the combustion system 500 to transfer from the preheating state to the standard operating state. The technician can cause the combustion system 500 to transition to the standard operating state by inputting commands to the controller 110 and/or by manually turning one or more switches, dials, knobs or other input devices, causing the plasma ignition device 108 to stop outputting the plasma stream 522.

Figure 5C:
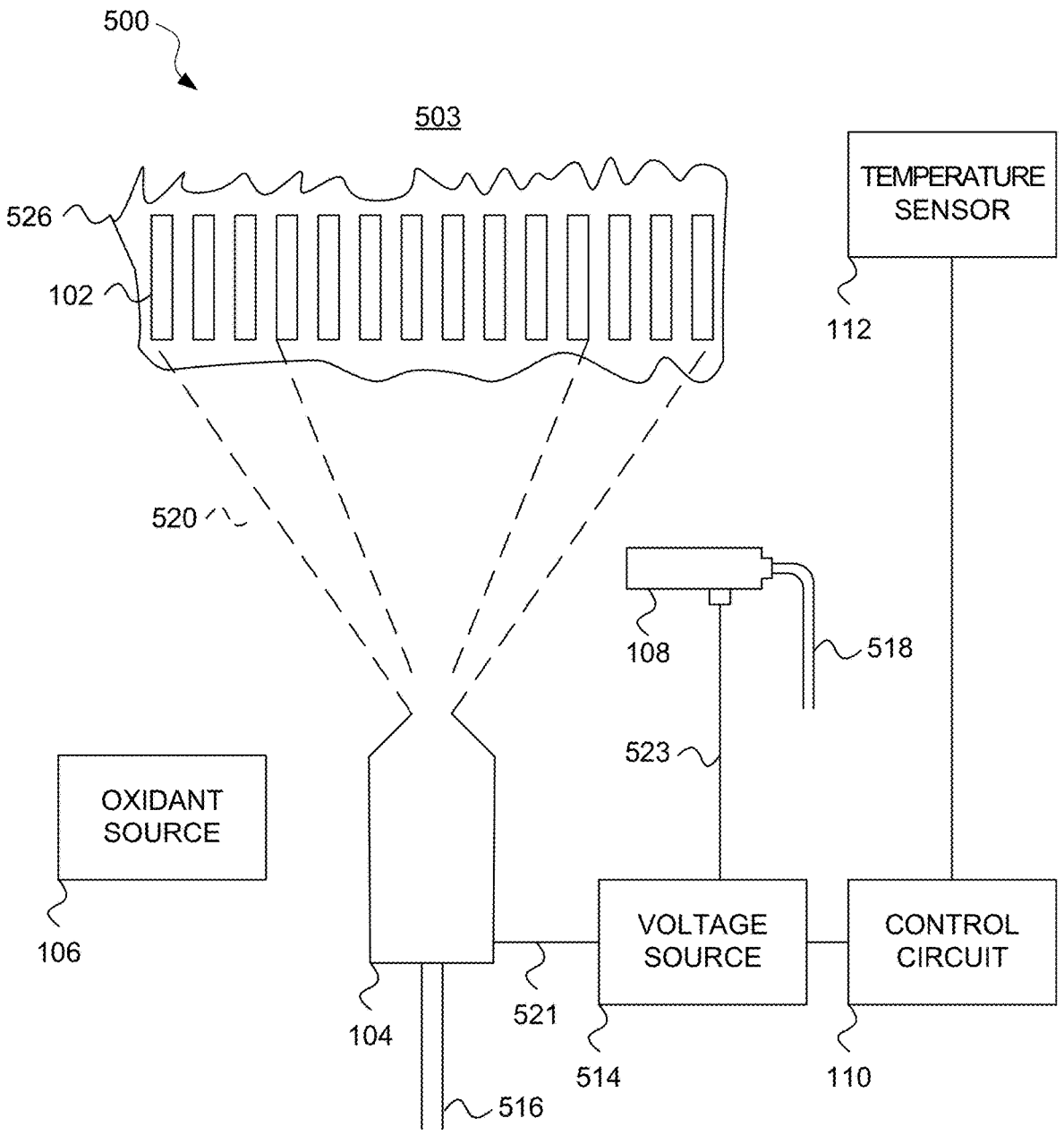
FIG. 5C is a diagram of the combustion system of FIG. 5A in a standard operating state, according to an embodiment.

FIG. 5C is a diagram of the combustion system 500 of FIG. 5A in a standard operating state. In the standard operating state, the perforated flame holder 102 has reached the threshold temperature and the fuel stream 520 impinges on the perforated flame holder 102. The perforated flame holder 102 sustains a stable combustion reaction 526 primarily within the perforated flame holder 102. In particular, because the fuel stream 520 arrives at or in the perforated flame holder 102 when the perforated flame holder 102 is at or above the threshold temperature, the perforated flame holder 102 is able to sustain the combustion reaction 526 within the perforated flame holder 102.

According to an embodiment, in the standard operating state the fuel nozzle 104 outputs the fuel stream 520 having the same characteristics as in the preheating state. However, because the plasma ignition device 108 does not output the plasma stream 522 in the standard operating state, the fuel stream 520 does not receive the additional energy that allows a stable combustion reaction 526 of the first fuel and oxidant to take place at a position between the perforated flame holder 102 and the fuel nozzle 104. In the standard operating state the fuel stream 520 is free to travel toward the perforated flame holder 102 until the fuel stream 520 has entered the perforations 110 of the perforated flame holder 102. The perforated flame holder 102 can support a combustion reaction 526 of the first fuel and oxidant 206 primarily within the perforated flame holder 102.

Figure 5D:
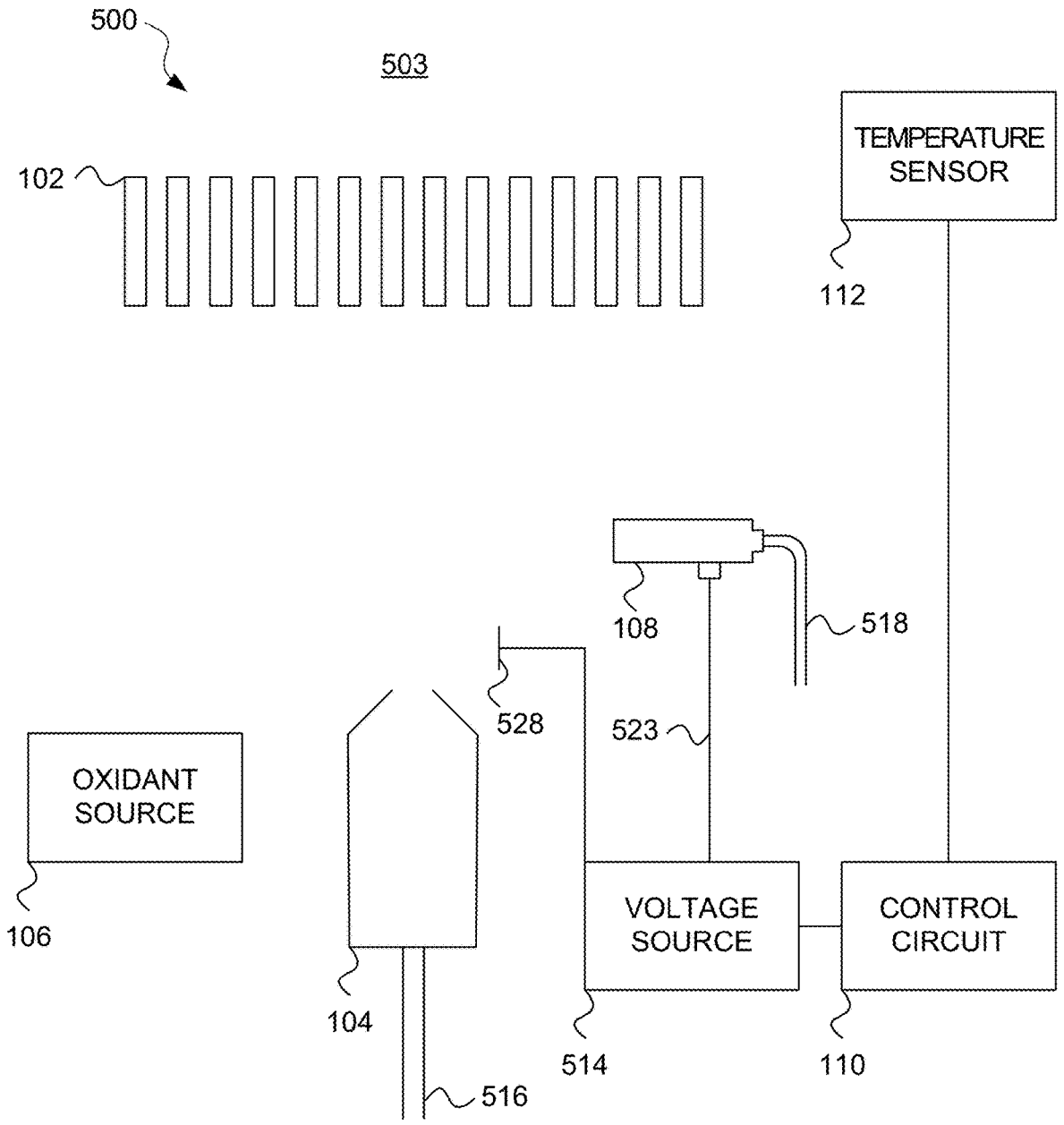
FIG. 5D is a diagram of a combustion system, according to an embodiment.

FIG. 5D is a diagram of the combustion system 500 according to an embodiment in which the first electrode 528 is positioned external to both the fuel nozzle 104 and the plasma ignition device 108. The combustion system 500 of FIG. 5D operates in substantially the same manner as described in relation to FIGS. 5A-5C, except that the first electrode 528 is positioned between the fuel nozzle 104 and the plasma ignition device 108.

Figure 5E:
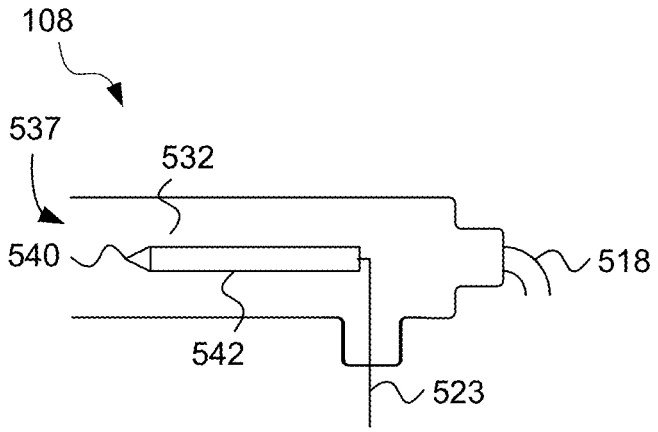
FIG. 5E is a cross-sectional diagram of a plasma ignition device of FIGS. 5A-5D, according to an embodiment.

FIG. 5E is a cross-sectional diagram of the plasma ignition device 108 of FIGS. 5A-5D, according to an embodiment. The plasma ignition device 108 includes a fluid channel 532 and a second electrode 540 positioned within the fluid channel 532. The second electrode 540 is covered in an electrical insulator 542 except at an exposed pointed tip. The fluid line 518 provides the input fluid into the fluid channel 532. As the input fluid flows past the second electrode 540, the series of sparks from the second electrode 540 generate a plasma from the input fluid. The plasma ignition device 108 outputs the plasma from an aperture 537.

Figure 5F:
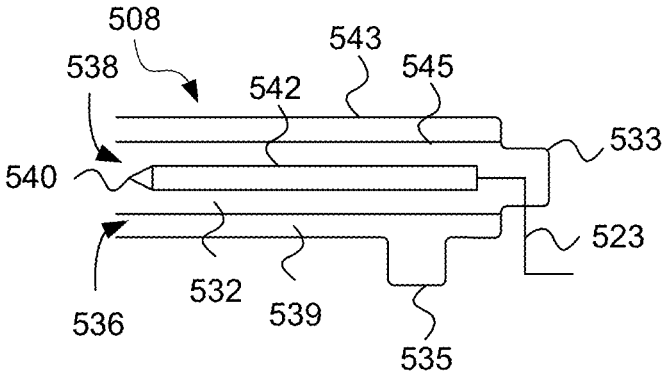
FIG. 5F is a cross-sectional diagram of a plasma ignition device, according to an embodiment.

FIG. 5F is a cross-sectional diagram of a plasma ignition device 508, according to an embodiment. The plasma ignition device 508 includes a fluid inlet 533 configured to receive an input fluid into a fluid channel 532. The plasma ignition device 508 includes a fuel inlet 535 configured to receive the second fuel into a fuel channel 539. In particular, the fluid inlet port 533 is configured to receive the input fluid from the fluid line 518. The fuel inlet port 535 is configured to receive the first fuel from a fuel line 516. The plasma ignition device 508 includes an interior wall 545 configured to separate the fluid channel 532 from the fuel channel 539. The plasma ignition device 508 also includes a casing 543 which serves as an outer wall defining an outer perimeter of the fuel channel 539. The plasma ignition device 508 includes a central aperture 538 through which the input fluid and/or plasma stream 522 can exit the fluid channel 532. The plasma ignition device 508 includes an outer aperture 536 through which the second fuel can exit the fuel channel 539.

According to an embodiment, the plasma stream 522 exiting the central aperture 538 can interact with the second fuel exiting the outer aperture 536, thereby causing a combustion reaction 526 of the second fuel and the plasma and/or the input fluid. This combustion reaction 526 in combination with the plasma can interact with the first fuel stream 520, thereby supporting the preheating flame 524 during the preheating state.

According to an embodiment, the plasma ignition device 508 can also function as the fuel nozzle 104. In particular, the fuel line 516 can supply the first fuel to the fuel channel 539 via the fuel inlet 535. In this case, the plasma ignition device 508 outputs the first fuel stream 520 from the outer aperture 536. The plasma ignition device 508 can be positioned and oriented such that the first fuel stream 520 is output toward the perforated flame holder 102. In the preheating state, the input fluid is provided to the fluid channel 532 and the high voltage is applied between the first electrode 528 and the second electrode 540. This causes the plasma ignition device 508 to output a plasma stream 522. The plasma stream 522 interacts with the first fuel stream 520, causing the preheating flame 524 to be supported at a position between the plasma ignition device 508 and the perforated flame holder 102. After the perforated flame holder 102 has been heated to the threshold temperature, the plasma ignition device 508 ceases outputting the plasma, thereby enabling the first fuel stream 520 to impinge on the perforated flame holder 102. The perforated flame holder 102 supports a combustion reaction 526 of the first fuel and oxidant 206 within the perforated flame holder 102. Thus, according to an embodiment the plasma ignition device 508 can include the fuel nozzle 104.

Figure 6A:
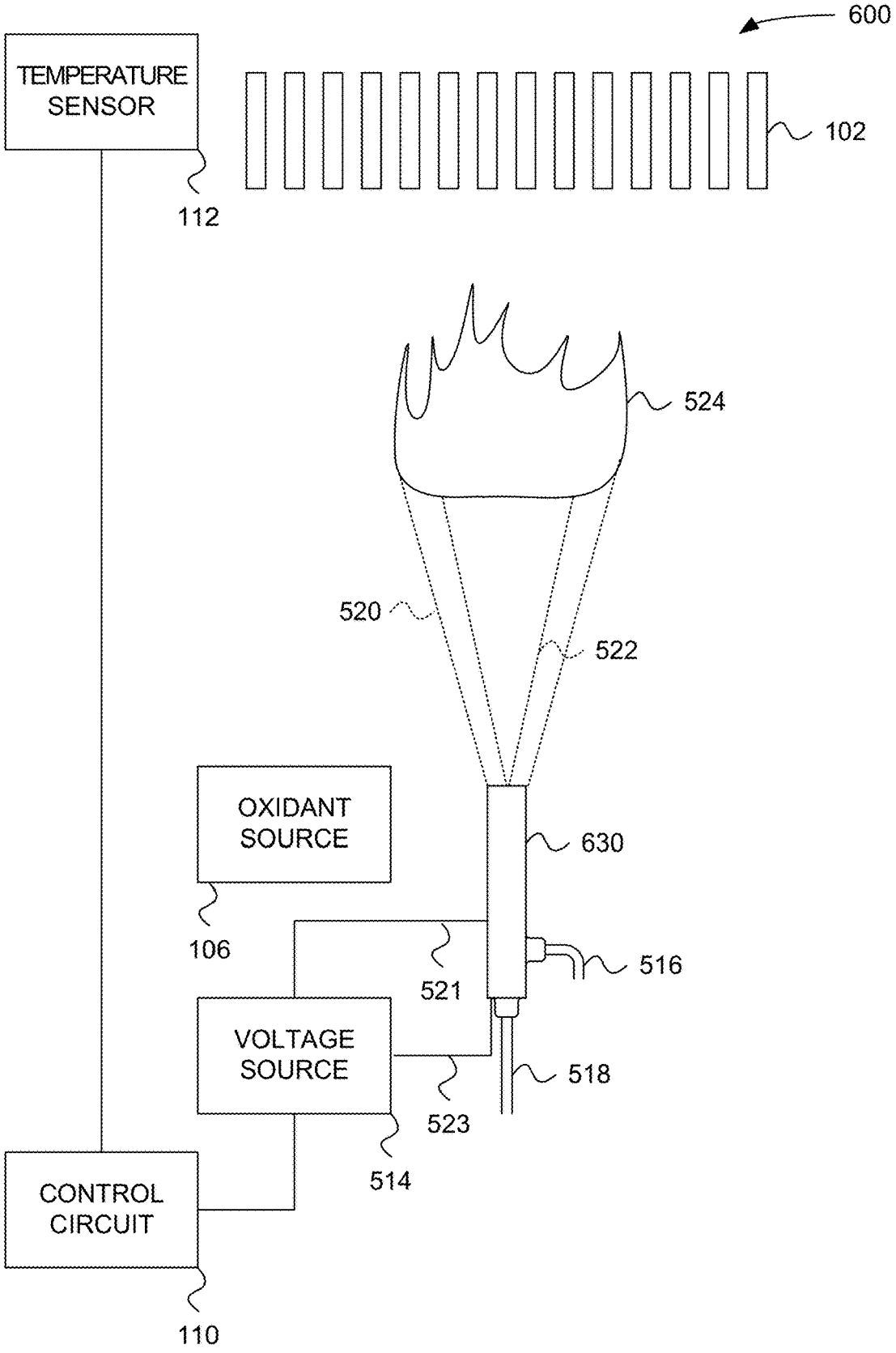
FIG. 6A is a diagram of a combustion system in a preheating state, according to an embodiment.

FIG. 6A is a diagram of a combustion system 600, according to an embodiment. The combustion system 600 includes a perforated flame holder 102 and a burner 630. The burner 630 includes, or functions as, both a fuel nozzle and a plasma ignition device. The combustion system 600 further includes an oxidant source 106, a voltage source 514, a controller 110, and a temperature sensor 112. The controller 110 is coupled to the temperature sensor 112 and the voltage source 514. The voltage source 514 is configured to apply a first voltage to a first electrode 528, for example an outer casing of the burner 630, via a first electrical connection 521. The voltage source 514 is configured to apply a second voltage to a second electrode 540 via a second electrical connection 523. A fuel line 516 supplies a first fuel to the burner 630. A fluid line 518 supplies an input fluid to the burner 630.

In FIG. 6A, the combustion system 600 is in a preheating state. In the preheating state the combustion system 600 preheats the perforated flame holder 102 to a threshold temperature at which the perforated flame holder 102 can sustain a stable combustion reaction 526 of the first fuel and oxidant 206 within the perforated flame holder 102.

According to an embodiment, in the preheating state the controller 110 causes the voltage source 514 to apply a high voltage between the first and second electrodes 528, 540 by applying the first voltage to the first electrode 528 via the first electrical connection 521 and by applying the second voltage to the second electrode 540 via the second electrical connection 523. The high voltage produces a series of sparks within the burner 630.

The fluid line 518 supplies an input fluid to the burner 630. As described previously, the input fluid can include air, a mixture of air and the second fuel, or another fluid. The series of sparks generate a plasma from the input fluid.

According to an embodiment, in the preheating state the fuel line 516 supplies a first fuel to the burner 630. The burner 630 outputs a fuel stream 520 including the first fuel toward the perforated flame holder 102.

According to an embodiment, the burner 630 outputs the fuel stream 520 and the plasma stream 522 in such a way that the plasma stream 522 can interact with the fuel stream 520. The high-energy plasma in the plasma stream 522 causes a combustion reaction 526 of the first fuel and oxidant 206 at a position between the perforated flame holder 102 and the burner 630. In particular, the plasma stream 522 generates a preheating flame 524 which is a stable combustion reaction 526 of the first fuel and oxidant 206 at a position between the burner 630 and the perforated flame holder 102.

According to an embodiment, the preheating flame 524 is positioned such that the preheating flame 524 heats the perforated flame holder 102. The preheating flame 524 heats the perforated flame holder 102 until the perforated flame holder 102 has reached a threshold temperature at which the perforated flame holder 102 can stably support a combustion reaction 526 of the first fuel and oxidant 206 within the perforated flame holder 102. Once the perforated flame holder 102 has reached the threshold temperature, the combustion system 600 transitions from the preheating state to a standard operating state.

According to an embodiment, the burner 630 includes a body that defines both a fuel nozzle 104 and a plasma ignition device 108.

According to an embodiment, the burner 630 is a plasma ignition device 108 that includes a fuel nozzle 104 configured to output the first fuel stream.

Figure 6B:
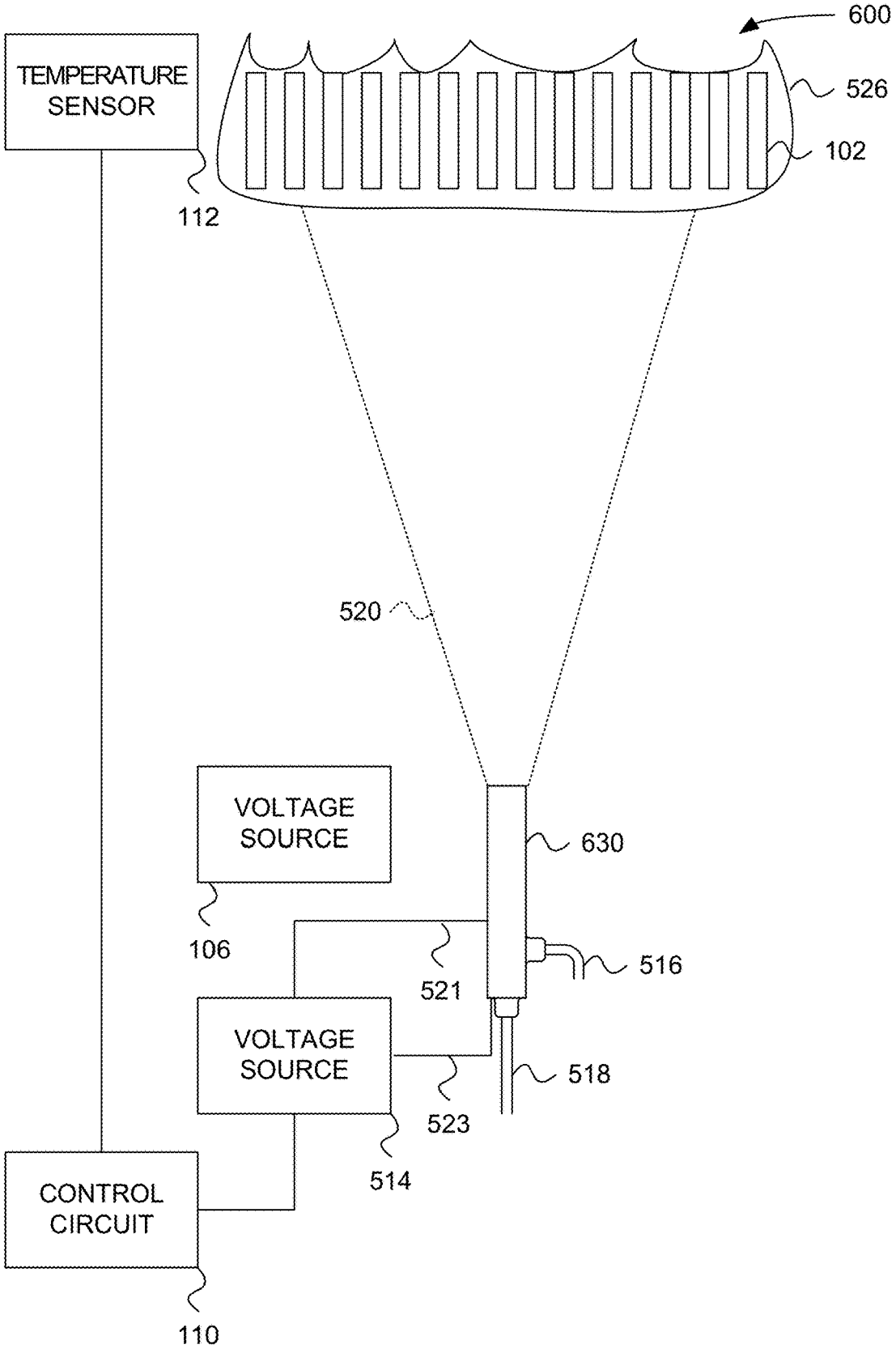
FIG. 6B is a diagram of the combustion system of FIG. 6A in a standard operating state, according to an embodiment.

FIG. 6B is a diagram of the combustion system 600 of FIG. 6A in a standard operating state. In the standard operating state, the perforated flame holder 102 has reached the threshold temperature and the fuel stream 520 impinges on the perforated flame holder 102. The perforated flame holder 102 sustains a stable combustion reaction 526 primarily within the perforated flame holder 102. In particular, because the fuel stream 520 arrives at or in the perforated flame holder 102 when the perforated flame holder 102 is at or above the threshold temperature, the perforated flame holder 102 is able to sustain the combustion reaction 526 within the perforated flame holder 102.

According to an embodiment, in the standard operating state the burner 630 outputs the fuel stream 520 having the same characteristics as in the preheating state. However, because the burner 630 does not output the plasma stream 522 in the standard operating state, the fuel stream 520 does not receive the additional energy that allows a combustion reaction 526 of the first fuel and oxidant 206 to take place at a position between the perforated flame holder 102 and the burner 630. In the standard operating state, the fuel stream 520 is free to travel toward the perforated flame holder 102 until the fuel stream 520 has entered the perforations 110 of the perforated flame holder 102. The perforated flame holder 102 can support a combustion reaction 526 of the first fuel and oxidant 206 primarily within the perforated flame holder 102.

Figure 6C:
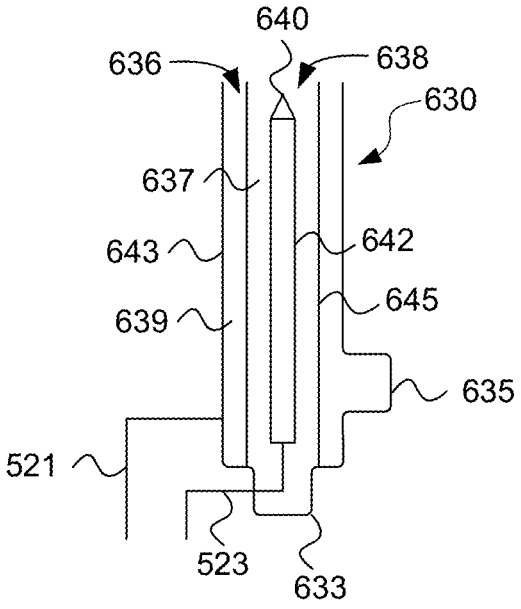
FIG. 6C is a cross-sectional diagram of a burner, according to an embodiment.

FIG. 6C is a cross-sectional diagram of the burner 630 of FIG. 6A, according to an embodiment. The burner 630 includes a fluid inlet 633 configured to receive an input fluid into a fluid channel 637. The burner 630 includes a fuel inlet 635 configured to receive the first fuel into a fuel channel 639. In particular, the fluid inlet port 633 is configured to receive input fluid from the fluid line 518. The fuel inlet port 635 is configured to receive the first fuel from the fuel line 516. The burner 630 includes an interior wall 645 configured to separate the fluid channel 637 from the fuel channel 639. The burner 630 also includes a casing 643. The casing can be an outer wall defining an outer perimeter of the fuel channel 639. The burner 630 includes a central aperture 638 through which the input fluid and/or plasma stream 522 can exit the fluid channel 637. The burner 630 includes an outer aperture 636 through which the fuel stream 520 can exit the fuel channel 639.

According to an embodiment, the outer casing 643 of the burner 630 serves as a first electrode. The second electrode 640 is positioned within the fluid channel 637. The second electrode 640 is covered in an insulating material 642, except for at the tip near the central aperture 638. The second electrode 640 can be, in one example, a tungsten electrode. Alternatively, the second electrode 640 can include another refractory metal or other conductive material suitable for being in a high temperature environment. The second electrode 640 is electrically isolated from the interior wall 645 and the casing 643.

The first electrical connection 521 is electrically coupled to the casing 643. The voltage source 514 can apply a first voltage to the casing 643 via the first electrical connection 521. The second electrical connection 523 is electrically connected to the second electrode 640. The second electrical connection 523 is electrically insulated from the casing 643. The second electrical connection 523 can pass through an aperture 636 in the casing 643 to connect with the electrode 640.

According to an embodiment, the second electrode 640, the fluid channel 637, the fluid inlet 633, and the central aperture 638 are collectively a plasma ignition device 108. According to an embodiment, the fluid channel 637, the fuel inlet 635, and the exterior aperture 636 collectively are a fuel nozzle.

As described previously, in the preheating condition an input fluid is introduced into the fluid channel 637 via the fluid inlet 633. A high voltage is generated between the electrode 640 and the casing 643. As the input fluid passes the electrode 640, a plasma 522 is generated from the input fluid. A plasma stream 522 is output via the central aperture 638. The input fluid is introduced into the fuel channel 639 via the fuel inlet 635. A fuel stream 520 is output from the aperture 636. The plasma stream 522 causes the fuel stream 520 to combust in a stable manner in the position between the burner 630 and the perforated flame holder 102. In this way, in the preheating state the burner 630 supports a preheating flame 524 at a position between the burner 630 and the perforated flame holder 102.

After the perforated flame holder 102 has been heated to the threshold temperature, the combustion system 600 enters the standard operating state. In the standard operating state, the input fluid is not supplied to the fluid channel 637 and the voltage source 514 does not apply the first and second voltages to the first and second electrodes 528, 540. The fuel stream 520 therefore continues unimpeded until it impinges on the preheated perforated flame holder 102. The perforated flame holder 102 supports a combustion reaction 526 of the first fuel and oxygen 206.

Figure 6D:
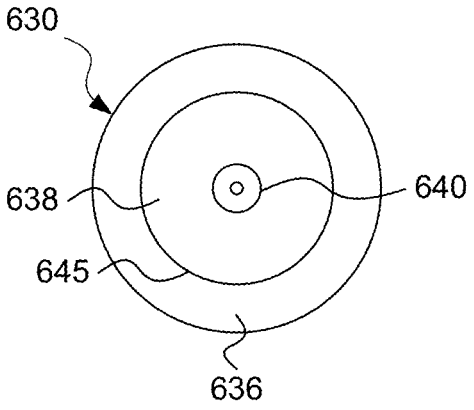
FIG. 6D is a top view of the burner of FIG. 6C, according to an embodiment.

FIG. 6D is a top view of the burner 630, according to an embodiment. The top view illustrates the central aperture 638, the outer aperture 636, the interior wall 645 separating fluid channel 637 from the fuel channel 639, the outer casing 643, and the second electrode 640.

Figure 7A:
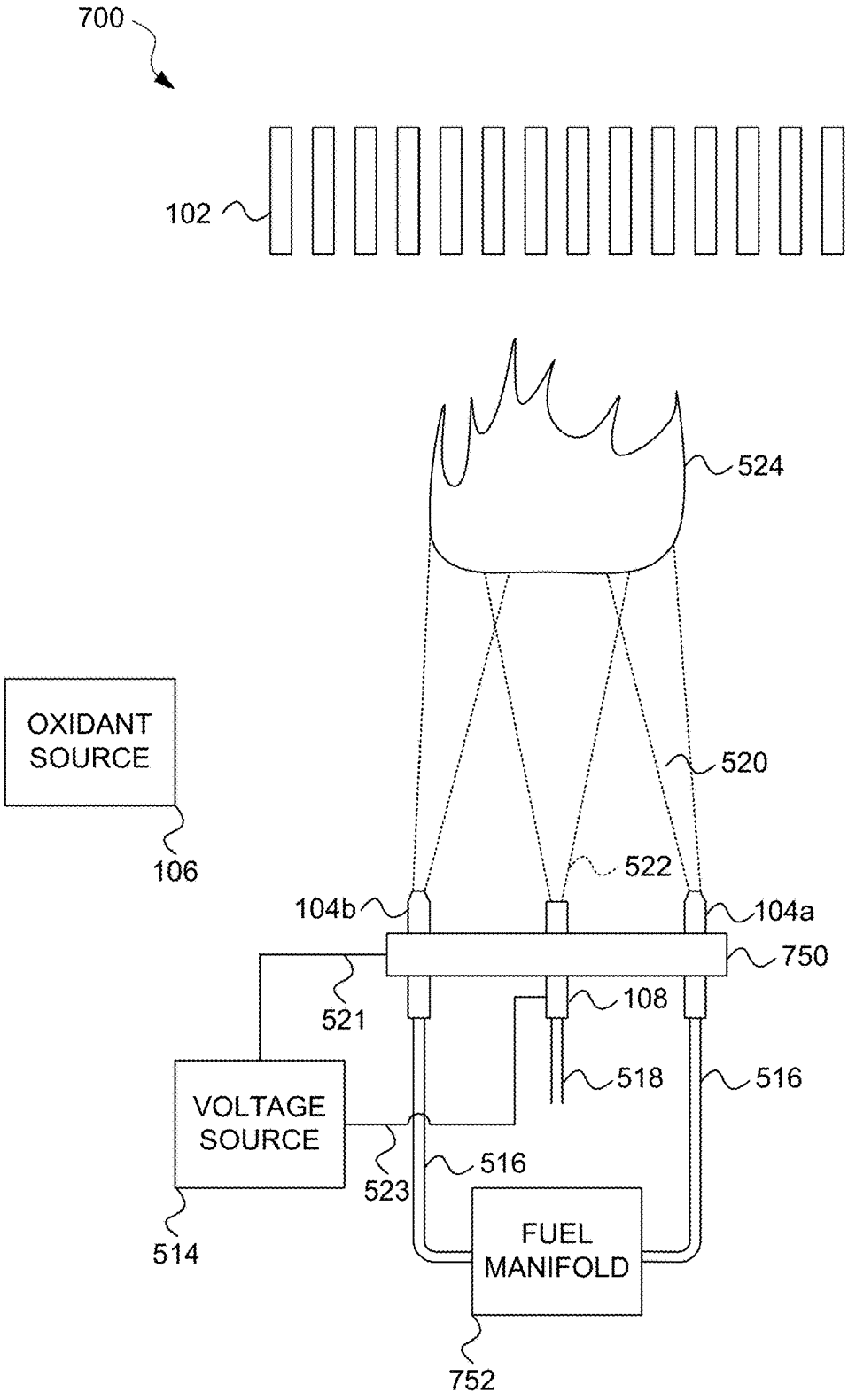
FIG. 7A is a diagram of a combustion system in a preheating state, according to an embodiment.

FIG. 7A is a diagram of a combustion system 700, according to an embodiment. The combustion system 700 includes a perforated flame holder 102, a plurality of fuel nozzles 104*a*-104*d* (only 104*a* and 104*b* are seen in FIG. 7A) and a plasma ignition device 108. The system includes a support structure 750 supporting the fuel nozzles 104*a*-104*d* and the plasma ignition device 108. The combustion system 700 further includes an oxidant source 106 configured to output an oxidant and a voltage source 514. The fuel nozzles 104*a*-104*d* are coupled to fuel lines 516. The fuel lines 516 provide fuel from a fuel manifold 752 to the fuel nozzles 104*a*-104*d*. A fluid line 518 supplies an input fluid to the plasma ignition device 108.

According to an embodiment, the support structure 750 acts as a first electrode. In particular, the voltage source 514 applies a first voltage to the support structure 750 at the first electrical connection 521. The support structure 750 can include a conductive material. The voltage source 514 can apply a second voltage to a second electrode 640, which is part of the plasma ignition device 108, and via an electrical connection 523.

In the preheating state, the plurality of fuel nozzles 104*a*-104*d* output fuel streams 520 toward the perforated flame holder 102. The plasma ignition device 108 outputs a plasma flow 522. The high-energy plasma flow 522 causes a combustion reaction 524 of the first fuel and oxidant 206 at a position between the fuel nozzles 104*a*-104*d* and the perforated flame holder 102. In particular, the plasma ignition device 108 is positioned to cause a combustion reaction 524 of the fuel streams 520 made by all of the fuel nozzles 104*a*-104*d*. A preheating flame 524 is stably supported at a position between the perforated flame holder 102 and the fuel nozzles 104*a*-104*d*.

After the perforated flame holder 102 has been heated to the threshold temperature, the combustion system 700 transitions to a standard operating state.

Figure 7B:
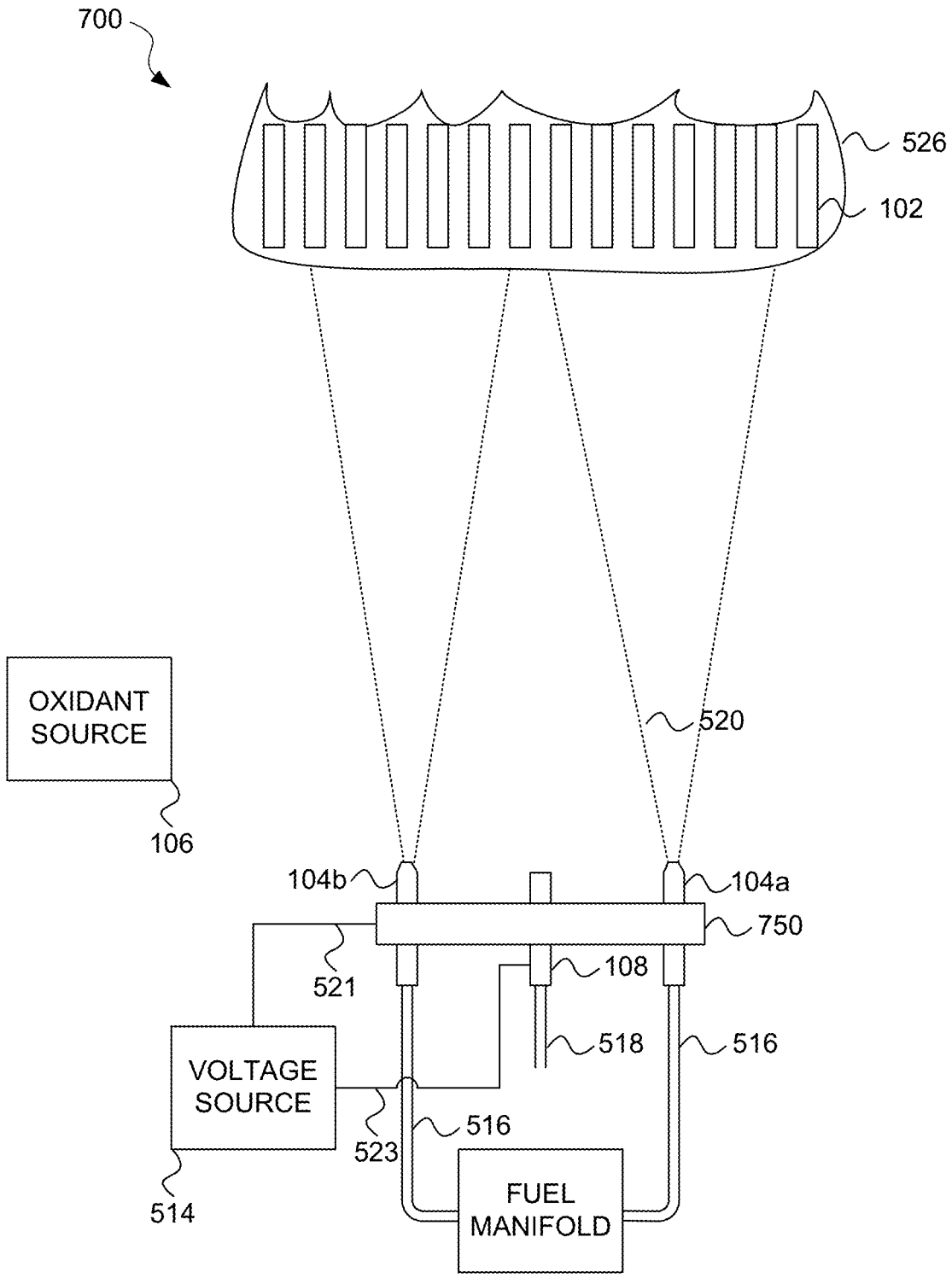
FIG. 7B is a diagram of the combustion system of FIG. 7A in a standard operating state, according to an embodiment.

FIG. 7B is a diagram of the combustion system 700 of FIG. 7A in a standard operating state, according to an embodiment. In the standard operating state, the plasma ignition device 108 has ceased outputting the plasma stream 522. With the plasma stream 522 no longer present, a combustion reaction 526 of the fuel streams 520 cannot be stably supported at a position between the fuel nozzles 104*a*-104*d* and the perforated flame holder 102. The fuel streams 520 therefore continue to impinge upon the perforated flame holder 102. Because the perforated flame holder 102 has been heated to the threshold temperature, the perforated flame holder 102 supports a stable combustion reaction 526 of the first fuel and oxidant 206 primarily within the perforated flame holder 102.

Figure 7C:
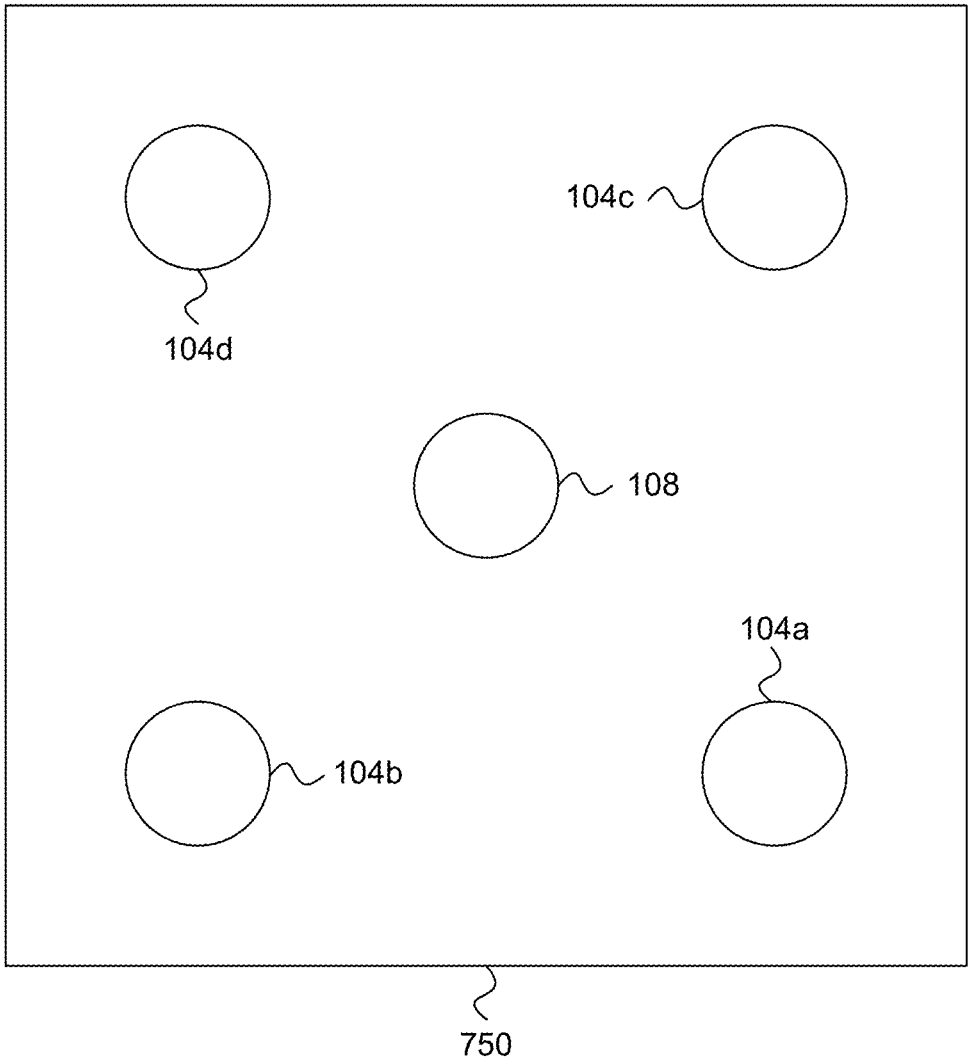
FIG. 7C is a top view of the support structure of FIGS. 7A-7B, according to an embodiment.

FIG. 7C is a top view of the support structure 750 of FIGS. 7A, 7B, according to an embodiment. The support structure 750 supports the fuel nozzles 104*a*-104*d* and the plasma ignition device 108. The fuel nozzles 104*a*-104*d* and the plasma ignition device 108 pass through apertures in the support structure 750. Thus, each fuel nozzle 104*a*-104*d* and the plasma ignition device 108 protrude through the support structure 750. The support structure 750 can receive the first voltage from the voltage source 514 via the first electrical connection 521. In one example, the first voltage is ground.

Figure 8:
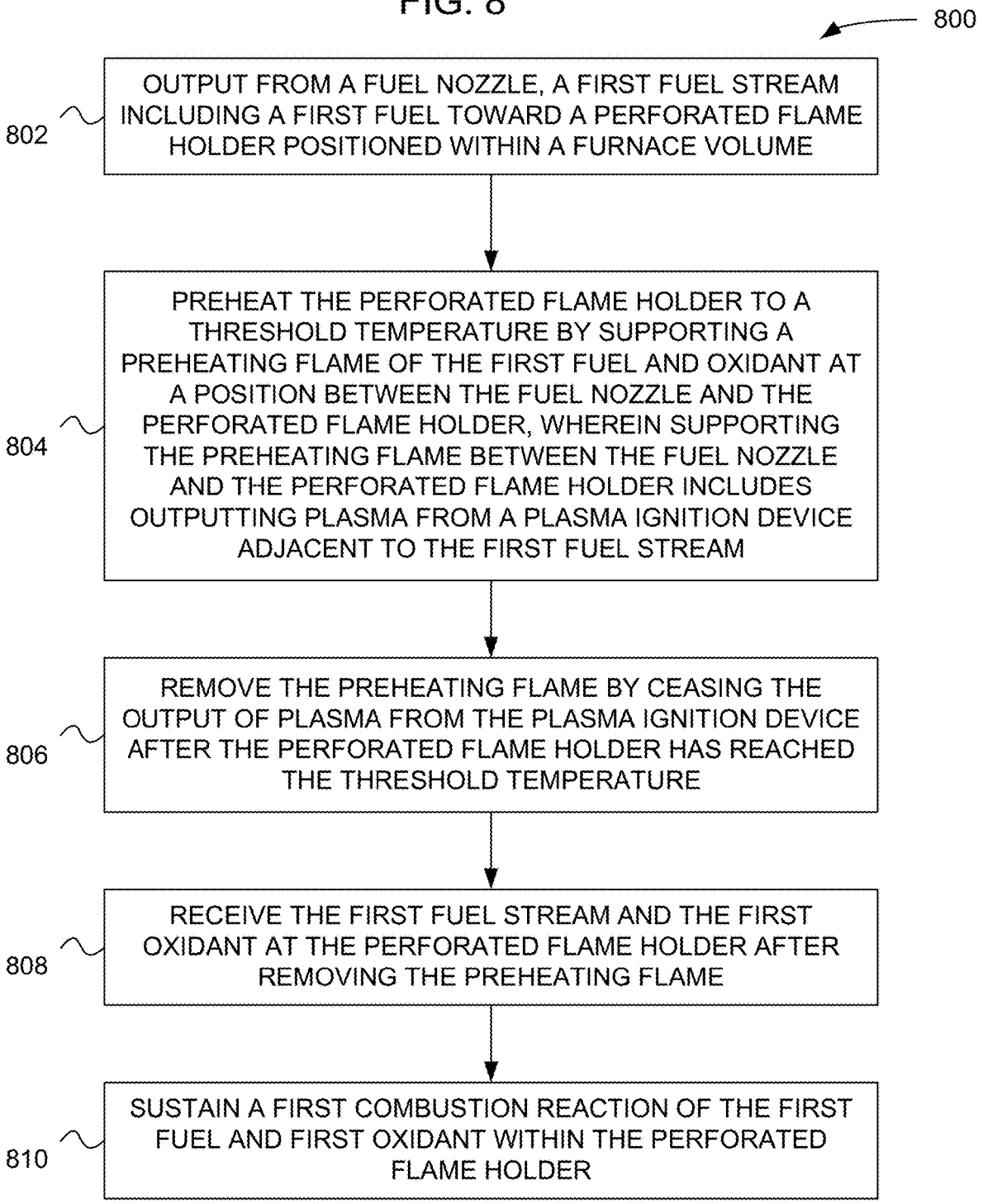
FIG. 8 is a flow diagram of a process for operating a combustion system, according to one embodiment.

FIG. 8 is a flow diagram of a process 800 for operating a combustion system, according to one embodiment. At 802 a first fuel stream is output from a fuel nozzle to a perforated flame holder positioned within the furnace volume. The first fuel stream includes a first fuel, according to an embodiment. At 804 the perforated flame holder is preheated to a threshold temperature by supporting a preheating flame of the first fuel and oxidant positioned between the fuel nozzle and the perforated flame holder, according to an embodiment. Supporting a preheating flame between the fuel nozzle and the perforated flame holder includes outputting a plasma stream from a plasma ignition device adjacent to the first fuel stream, according to an embodiment. At 806 the preheating flame is removed by ceasing the output of the plasma stream from the plasma ignition device after the perforated flame holder has reached the threshold temperature, according to an embodiment. If the perforated flame holder has not reached the threshold temperature, the plasma ignition device continues to output the plasma stream until the perforated flame holder has reached the threshold temperature. At 808 the perforated flame holder receives the first fuel stream and the first oxidant at the perforated flame holder after the preheating flame is been removed, according to an embodiment. At 810 the perforated flame holder sustains a first combustion reaction of the first fuel in the first oxidant within the perforated flame holder, according to an embodiment.

Figure 9A:
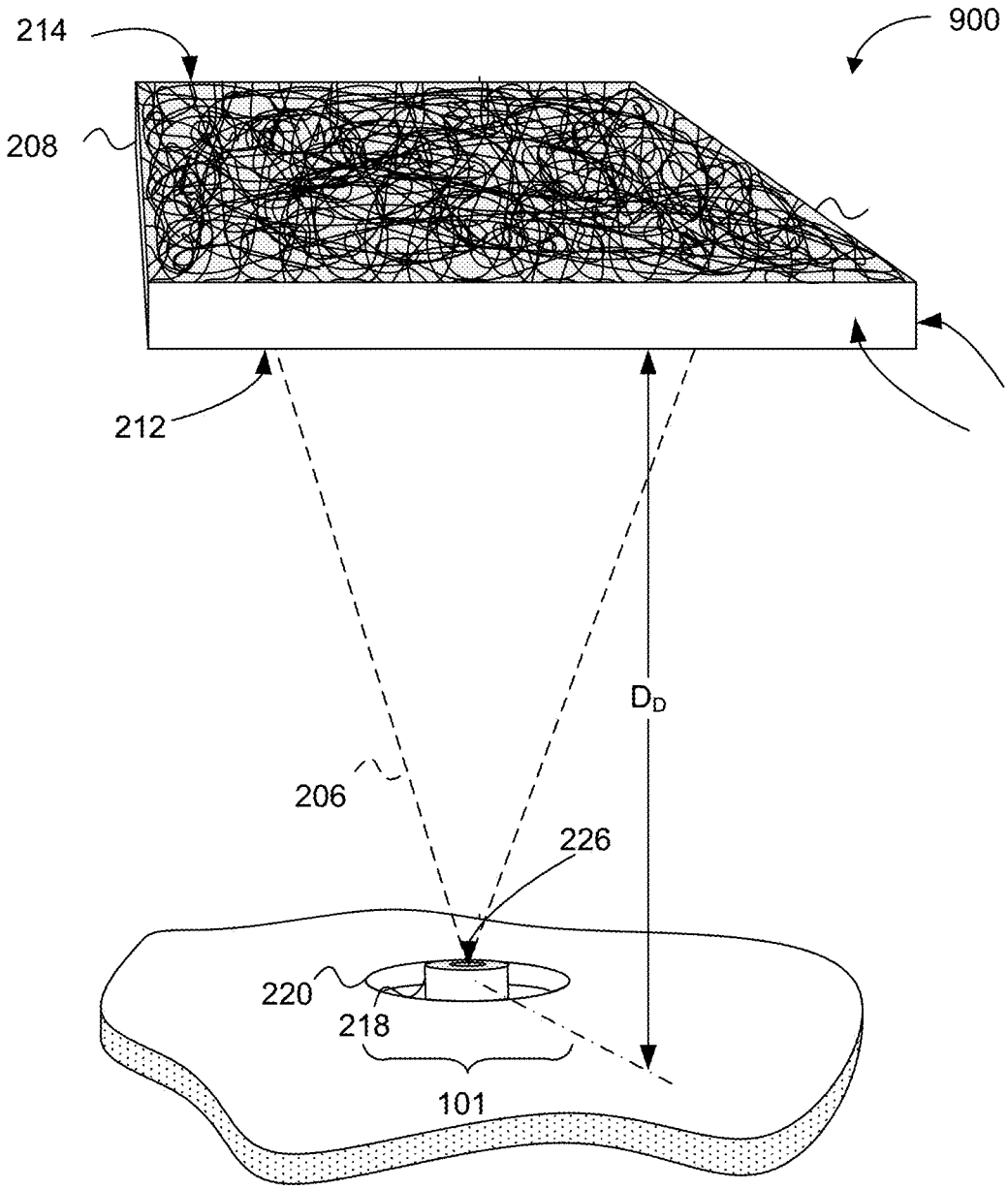
FIG. 9A is a simplified perspective view of a combustion system including a reticulated ceramic perforated flame holder, according to an embodiment.
Figure 9B:
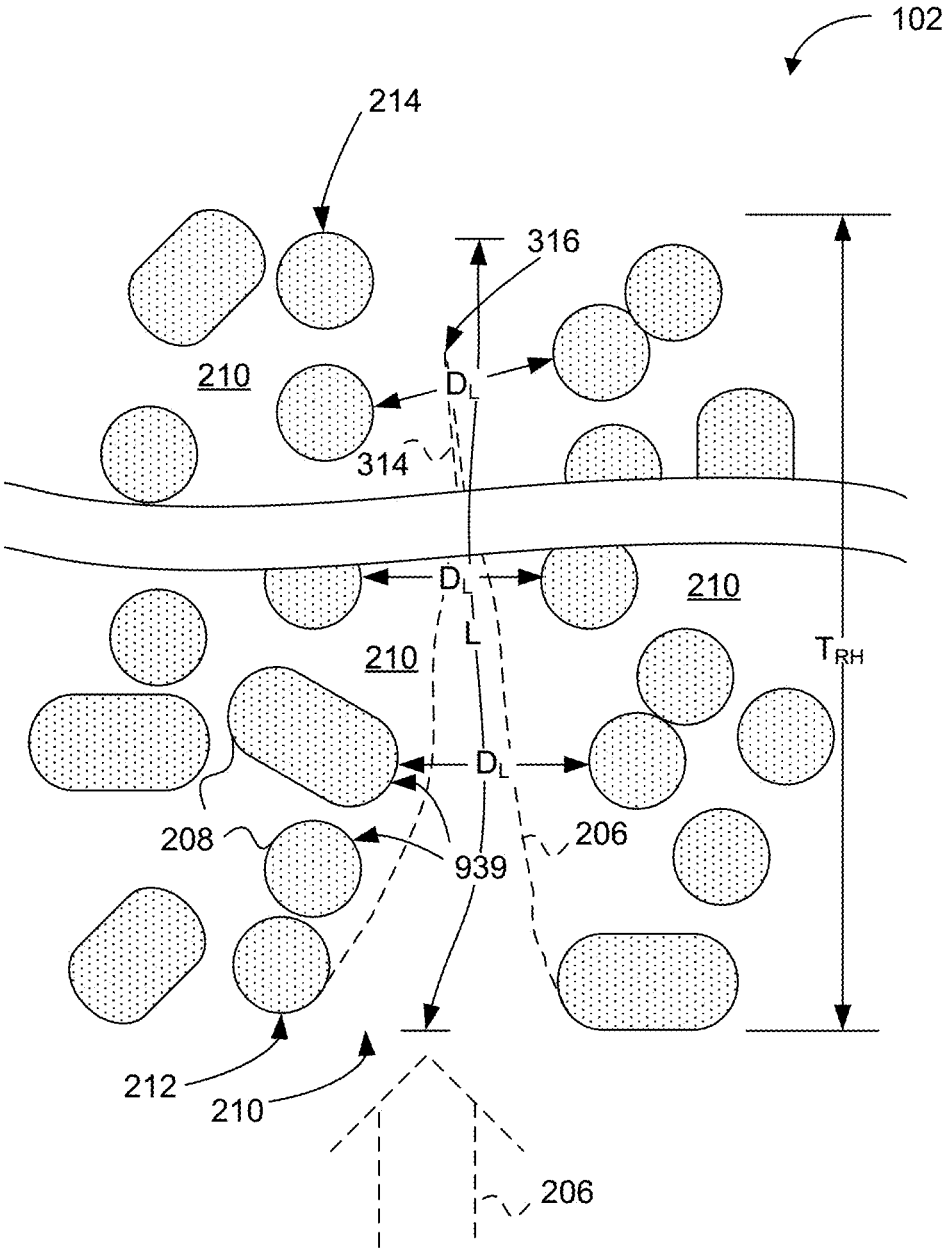
FIG. 9B is a simplified side sectional diagram of a portion of the reticulated ceramic perforated flame holder of FIG. 9A, according to an embodiment.

FIG. 9A is a simplified perspective view of a combustion system 900, including another alternative perforated flame holder 102, according to an embodiment. The perforated flame holder 102 is a reticulated ceramic perforated flame holder 102 including a discontinuous perforated flame holder body 208 with branching perforations, according to an embodiment. FIG. 9B is a simplified side sectional diagram of a portion of the reticulated ceramic perforated flame holder 102 of FIG. 9A, according to an embodiment. The reticulated ceramic perforated flame holder 102 of FIG. 9A, 9B can be implemented in the various combustion systems described herein, according to an embodiment. The reticulated ceramic perforated flame holder 102 is configured to support a combustion reaction of the fuel and oxidant at least partially within the reticulated ceramic perforated flame holder 102. According to an embodiment, the reticulated ceramic perforated flame holder 102 can be configured to support a combustion reaction of the fuel and oxidant upstream, downstream, within, and adjacent to the reticulated ceramic perforated flame holder 102.

Referring to FIGS. 9A and 9B, the perforated flame holder body 208 can be discontinuous. The perforated flame holder body 208 can define perforations 210 that branch from one another. According to an embodiment, the perforated flame holder body 208 can include stacked sheets of material, each sheet having openings non-registered to the openings of a subjacent or superjacent sheet. "Non-registered" openings (described below) refer to openings that cause branching of oxidation fluid flow paths. "Non-registered" openings may, in fact, correspond to patterns that have preplanned differences in location from one another. "Registered" openings, which cause the perforations 210 to be separated from one another may also have preplanned differences in location from one sheet to another (or may be super-positioned to one another) but "registered" openings do not cause branching, and hence the perforations 210 are separated from one another.

According to an embodiment, the perforated flame holder body 208 can include fibers 939 including reticulated fibers. The fibers 939 can define branching perforations 208 that weave around and through the fibers 939.

According to an embodiment, the fibers 939 can include an alumina silicate. For example, the fibers 939 can be formed from extruded mullite or cordierite. According to an embodiment, the reticulated ceramic perforated flame holder 102 can include Zirconia. In another embodiment, the fibers 939 can include a metal. For example, the fibers 939 can include stainless steel and/or a metal superalloy.

The term "reticulated fibers" refers to a netlike structure. According to an embodiment, the fibers 939 are formed from an extruded ceramic material. In reticulated fiber embodiments, the interaction between the fuel and oxidant, the combustion reaction, and heat transfer to and from the perforated flame holder body 208 can function similarly to the embodiment shown and described above with respect to FIGS. 2-4. One difference in activity is a mixing between perforations 210, because the fibers 939 form a discontinuous perforated flame holder body 208 that allows flow back and forth between neighboring perforations.

According to an embodiment, the reticulated fiber network 939 is sufficiently open for downstream fibers to emit radiation for receipt by upstream fibers for the purpose of heating the upstream fibers sufficiently to maintain combustion of a fuel and oxidant mixture. Compared to a continuous perforated flame holder body, heat conduction paths 312 between fibers 939 are reduced due to separation of the fibers. This may cause relatively more heat to be transferred from the heat-receiving region 306 (heat receiving area) to the heat-output region 310 (heat output area) of the perforation wall 308 via thermal radiation.

According to an embodiment, the reticulated ceramic perforated flame holder is a tile about 1"×4"×4". According to an embodiment, the reticulated ceramic perforated flame holder includes about 100 pores per square inch of surface area. Other materials and dimensions can also be used for a reticulated ceramic perforated flame holder in accordance with principles of the present disclosure.

According to an embodiment, the reticulated ceramic perforated flame holder 102 can include shapes and dimensions other than those described herein. For example, the perforated flame holder 102 can include reticulated ceramic tiles that are larger or smaller than the dimensions set forth above. Additionally, the reticulated ceramic perforated flame holder 102 can include shapes other than generally cuboid shapes.

According to an embodiment, the reticulated ceramic perforated flame holder 102 can include multiple reticulated ceramic tiles. The multiple reticulated ceramic tiles can be joined together such each ceramic tile is in direct contact with one or more adjacent reticulated ceramic tiles. According to an embodiment, the multiple reticulated ceramic tiles can be separated from each other by gaps. The multiple reticulated ceramic tiles can collectively form a single perforated flame holder 102. Alternatively, each reticulated ceramic tile can be considered a distinct perforated flame holder.

According to an embodiment, in a case in which the perforated flame holder 102 includes multiple reticulated ceramic tiles separated by gaps, the perforated flame holder 102 can be configured to sustain a combustion reaction of the fuel and oxidant upstream, downstream, within, and between the reticulated ceramic tiles.

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A method, comprising:

outputting, from a fuel nozzle, a first fuel stream including a first fuel toward a perforated flame holder positioned within a furnace volume;

introducing a first oxidant into the furnace volume;

preheating the perforated flame holder to a threshold temperature by supporting a preheating flame of the first fuel and the first oxidant at a position between the fuel nozzle and the perforated flame holder, wherein supporting the preheating flame between the fuel nozzle and the perforated flame holder includes outputting plasma from a plasma ignition device adjacent to the first fuel stream;

removing the preheating flame by ceasing the output of plasma from the plasma ignition device after the perforated flame holder has reached the threshold temperature;

receiving the first fuel stream and the first oxidant at the perforated flame holder after removing the preheating flame; and sustaining a first combustion reaction of the first fuel and the first oxidant within the perforated flame holder.

2. The method of claim 1, wherein outputting the plasma includes outputting oxygen radicals.

3. The method of claim 2, wherein outputting the plasma includes outputting nitrogen radicals.

4. The method of claim 3, wherein outputting the plasma includes:

receiving an input fluid including oxygen and nitrogen into the plasma ignition device;

applying a high voltage between a first electrode and a second electrode, the plasma ignition device including the second electrode;

generating the plasma by passing the input fluid near the second electrode; and outputting the plasma from the plasma ignition device.

5. The method of claim 4, wherein applying the high voltage between the first electrode and the second electrode includes:

applying a first voltage to the first electrode; and applying a second voltage to the second electrode.

6. The method of claim 4, further comprising generating a series of sparks at the second electrode by applying the high voltage between the first electrode and the second electrode.

7. The method of claim 6, wherein generating the series of sparks includes generating more than 5,000 sparks per second.

8. The method of claim 4, wherein generating the plasma includes generating a continuous electrical discharge between the first and the second electrodes by applying the high voltage between the first and the second electrodes.

9. The method of claim 4, wherein the input fluid includes a second fuel and a second oxidant and wherein outputting the plasma includes supporting a second combustion reaction of the second fuel and the second oxidant.

10. The method of claim 9, wherein the input fluid is a mixture of the second fuel and the second oxidant.

11. The method of claim 10, wherein the second oxidant is air.

12. The method of claim 9, wherein supporting the preheating flame includes applying thermal energy from the second combustion reaction to the first fuel stream.

13. The method of claim 9, wherein the second fuel includes hydrocarbons.

14. The method of claim 13, wherein the second fuel includes methane.

15. The method of claim 4, wherein the input fluid includes air.

16. The method of claim 2, wherein supporting the preheating flame includes combusting the first fuel with the oxygen radicals.

17. The method of claim 1, further comprising outputting a plurality of first fuel streams from a plurality of fuel nozzles towards the perforated flame holder.

18. The method of claim 17, wherein supporting the preheating flame includes supporting the preheating flame with the first fuel from the plurality of first fuel streams and the first oxidant.

19. The method of claim 17, further comprising receiving the plurality of first fuel streams at the perforated flame holder after removing the preheating flame.

20. The method of claim 1, wherein a mass-flow rate of the first fuel stream is the same while supporting the preheating flame and while sustaining the first combustion reaction.

21. The method of claim 1, further comprising entraining the first oxidant in the first fuel stream as the first fuel stream travels towards the perforated flame holder.

22. The method of claim 1, wherein introducing the first oxidant into the furnace volume includes drafting the first oxidant into the furnace volume.

23. The method of claim 22, wherein the first oxidant includes air.

24. The method of claim 1, including selecting the fuel stream to not stably support the preheating flame between the fuel nozzle and the perforated flame holder in the absence of the plasma.

25. The method of claim 1, wherein the perforated flame holder includes a plurality of perforations formed as passages between the reticulated fibers, and wherein the perforations are branching perforations that extend between an input face of the perforated flame holder proximal to the fuel nozzle, and an output face of the perforated flame holder distal to the fuel nozzle.

26. The method of claim 1, wherein the perforated flame holder is configured to support at least a portion of the combustion reaction within the perforated flame holder between an input face thereof and an output face thereof.

27. A combustion system, comprising:

a furnace volume;

a perforated flame holder disposed within the furnace volume;

a fuel nozzle configured to output a first fuel stream including a first fuel toward the perforated flame holder;

an oxidant source configured to introduce a first oxidant into the furnace volume; and a plasma ignition device configured to heat the perforated flame holder to a threshold temperature by supporting a preheating flame with the first fuel stream between the perforated flame holder and the fuel nozzle by outputting a plasma adjacent to the first fuel stream, the plasma ignition device being configured to transition the perforated flame holder to a standard operating condition by ceasing output of the plasma after the perforated flame holder has reached the threshold temperature such that the first fuel impinges on the perforated flame holder in the absence of the plasma, the perforated flame holder being configured to support a first combustion reaction of the first fuel and the first oxidant in the standard operating condition.

28. The combustion system of claim 27, further comprising:

a first electrode positioned adjacent to the first fuel stream; and a second electrode housed within the plasma ignition device.

29. The combustion system of claim 28, further comprising a voltage source configured to apply a first voltage to the first electrode and a second voltage to the second electrode.

30. The combustion system of claim 29, wherein the plasma ignition device is configured to generate sparks when the first voltage is applied to the first electrode and the second voltage is applied to the second electrode.

31. The combustion system of claim 29, wherein the first electrode is positioned within the plasma ignition device.

32. The combustion system of claim 29, wherein the plasma ignition device includes a fluid inlet configured to receive an input fluid.

33. The combustion system of claim 32, wherein the plasma ignition device generates the plasma from the input fluid with the sparks.

34. The combustion system of claim 33, wherein the input fluid includes air and the plasma includes oxygen radicals.

35. The combustion system of claim 34, wherein the input fluid includes a second fuel.

36. The combustion system of claim 35, wherein the plasma ignition device is configured to cause combustion of the second fuel and the air.

37. The combustion system of claim 36, wherein the plasma further includes a second combustion reaction of the second fuel and the air.

38. The combustion system of claim 35, wherein the second fuel includes methane.

39. The combustion system of claim 33, wherein the plasma causes conditions within the furnace volume that enable the fuel stream to stably support the preheating flame, and wherein in the absence of the plasma, conditions within the furnace volume do not allow a stable combustion reaction of the first fuel and the first oxidant at a position between the fuel nozzle and the perforated flame holder.

40. The combustion system of claim 28, further comprising:

a plurality of fuel nozzles each configured to output a fuel stream including the first fuel; and a support structure that holds the plurality of fuel nozzles and the plasma ignition device in relative positions that enable the plasma ignition device to support the preheating flame of the first fuel in the fuel streams and the first oxidant when in a preheating state.

41. The combustion system of claim 40, wherein the support structure includes the first electrode.

42. The combustion system of claim 27, wherein the plasma ignition device includes the fuel nozzle.

43. The combustion system of claim 27, further comprising a burner having a casing that houses the plasma ignition device and the fuel nozzle.

44. The combustion system of claim 28, further comprising a burner including a burner body that includes:

an interior wall;

an interior fluid channel defined by the interior wall, the second electrode being positioned within the interior fluid channel;

a fluid inlet configured to receive a fluid into the interior fluid channel, the plasma ignition device including the interior fluid channel, the plasma ignition device being configured to generate the plasma by passing the fluid within the interior fluid channel adjacent to the second electrode;

a central aperture configured to output the plasma from the fluid channel;

an outer casing defining a fuel channel between the interior wall and the outer casing;

a fuel inlet configured to receive the first fuel into the fuel channel; and an exterior aperture configured to output the fuel stream from the fuel channel.

45. The combustion system of claim 27, wherein the perforated flame holder is a reticulated ceramic perforated flame holder.

46. The combustion system of claim 45, wherein the perforated flame holder includes a plurality of reticulated fibers.

47. The combustion system of claim 46, wherein the perforated flame holder includes at least one of zirconia, silicon carbide, extruded mullite, and cordierite.

48. The combustion system of claim 46, wherein the perforated flame holder includes a plurality of perforations formed as passages between the reticulated fibers, and wherein the perforations are branching perforations that extend between an input face of the perforated flame holder proximal to the fuel nozzle, and an output face of the perforated flame holder distal to the fuel nozzle.

49. The combustion system of claim 48, wherein the perforated flame holder is configured to support at least a portion of the combustion reaction within the perforated flame holder between the input face and the output face.

50. A burner, comprising:

an outer casing;

an interior wall within the outer casing;

a fuel channel defined between the outer casing and the interior wall;

a fluid channel surrounded by the interior wall;

an electrode positioned in the fluid channel;

a fuel inlet configured to receive a first fuel into the fuel channel;

a fluid inlet configured to receive a fluid into the fluid channel;

the electrode and the fluid channel being configured to generate a plasma by passing the fluid within the fluid channel adjacent to the electrode;

a central aperture configured to output the plasma from the fluid channel; and an exterior aperture configured to output a fuel stream including the first fuel from the fuel channel toward a perforated flame holder.

* * * * *